US006791023B2

(12) United States Patent
Nakaya

(10) Patent No.: US 6,791,023 B2
(45) Date of Patent: Sep. 14, 2004

(54) BOWED STRINGED MUSICAL INSTRUMENT FOR GENERATING ELECTRIC TONES CLOSE TO ACOUSTIC TONES

(75) Inventor: Hiroshi Nakaya, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/294,704

(22) Filed: Nov. 14, 2002

(65) Prior Publication Data

US 2003/0094094 A1 May 22, 2003

(30) Foreign Application Priority Data

Nov. 16, 2001 (JP) ..... 2001-352214
Nov. 16, 2001 (JP) ..... 2001-352215
Nov. 21, 2001 (JP) ..... 2001-356547

(51) Int. Cl.[7] ..... G10H 1/12
(52) U.S. Cl. ..... 84/736
(58) Field of Search ..... 84/736, 746, 236

(56) References Cited

U.S. PATENT DOCUMENTS 4,348,930 A * 9/1982 Chobanian et al. ..... 84/726
4,860,625 A * 8/1989 Mathews ..... 84/731
5,078,041 A * 1/1992 Schmued ..... 84/731
5,455,381 A * 10/1995 Juszkiewicz et al. ..... 84/731
5,905,222 A 5/1999 Yamada
5,945,622 A 8/1999 Yamada
6,392,137 B1 * 5/2002 Isvan ..... 84/726
6,448,488 B1 * 9/2002 Ekhaus et al. ..... 84/735

* cited by examiner

*Primary Examiner*—Jeffrey W Donels
(74) *Attorney, Agent, or Firm*—Morrison & Foerster LLP

(57) ABSTRACT

An electric violin has a combination of two sorts of vibration detectors for transverse vibration components and vertical vibration components, a low-pass filter connected to the vibration detector for the transverse vibration components and a high-pass filter connected to the vibration detector for the vertical vibration components, piezoelectric transducers connected in parallel to a signal processing system, or vibration detectors connected to filter circuits different in frequency characteristics for producing right-channel and left-channel signals so that the electric violin generate electric tones close to acoustic violin tones.

23 Claims, 26 Drawing Sheets

BOWED STRINGED MUSICAL INSTRUMENT FOR GENERATING ELECTRIC TONES CLOSE TO ACOUSTIC TONES

FIELD OF THE INVENTION

This invention relates to an electric musical instrument and, more particularly, to an electric bowed stringed musical instrument equipped with a plurality of mechanical vibration-to-electric signal converters.

DESCRIPTION OF THE RELATED ART

Electric bowed stringed musical instruments are new members of the violin family. Strings are stretched over bodies, and the players bow the strings as similar to the members of the violin family, i.e., violins, violas and cellos. The players give rise to vibrations of the strings through the bowing, and the vibrating strings generate tones. Although the acoustic members of the violin family have respective resonators for increasing the loudness of the tones, the electric bowed stringed musical instruments do not have the resonators, but are equipped with pickup units. The pickup units convert the vibrations of the strings to electric signals representative of the waveforms of the mechanical vibrations, and the electric signals are amplified before conversion to electric tones through speaker systems. Thus, the electric bowed stringed musical instruments electrically increase the tones, and the resonators are not required for the electric bowed stringed musical instruments.

There is a compromise between the acoustic bowed stringed musical instrument and the electric bowed stringed musical instrument. An acoustic bowed stringed musical instrument is equipped with a pickup unit, and the pickup unit converts the vibrations of strings to an electric signal. The compromise is hereinbelow referred to as "electric acoustic bowed stringed musical instrument".

One of the attractive features of the electric bowed musical instrument is the silent mode. The resonators are indispensable for the acoustic bowed stringed musical instruments, and always increase the loudness through the resonation. It is not easy to deactivate the resonators. This means that players disturb the neighborhood. However, the resonators are eliminated from the electric bowed stringed musical instruments. The loudness is electrically increased. If the user connects a headphone to the amplifier, he or she can practice the bowing without disturbance of the neighborhood.

FIG. 1 shows a typical example of the electric violin. The electric violin 1 comprises a trunk 2, a frame body 3, a fingerboard 4, a peg box 5 and a chin rest 6. The frame body 3 has a contour like a half of the outline of the resonator, and sideward projects from the trunk 2. The chin rest 6 sideward projects from the rear portion of the trunk 2, and a player puts his or her chin on the chin rest 6 during the bowing. The fingerboard 4 projects from the front end of the trunk 2, and the peg box 5 is fixed to the leading end of the fingerboard 4.

The electric violin 1 further comprises four strings 7, peg screws 8, a tailpiece 9, a bridge 10 and a pickup unit 11. The peg screws 8 are turnably supported by the peg box 5, and the tailpiece is fixed to the upper surface of the rear portion of the trunk 2. The strings 7 are anchored to the tailpiece 9, and are wound up at the other end portions around the peg screws 8. The bridge 10 is provided on the upper surface of the trunk 2, and exerts tension to the strings 7. Although the component part 10 is not same as the bridge of the acoustic violin, the component part 10 is referred to as "bridge" in the description. The pickup unit 11 is provided between the upper surface of the trunk 2 and the lower surface of the bridge 10, and converts the vibrations to an electric signal.

FIG. 2 illustrates the bridge 10 and pickup unit 11 on the trunk 2. The bridge 10 is formed from a thin plate, and has a gently curved upper surface. Notches 10*a* are formed in the bridge 10, and are open to the outside on the gently curved upper surface. The strings 7 are received in the notches 10*a* so that the bridge 10 keeps the strings 7 spaced at intervals. While a player is bowing the strings 7, the strings 7 vibrate, and the vibrating strings 7 gives rise to vibrations of the bridge 10.

The bridge 10 has leg portions 10*b* and 10*c*, and piezoelectric transducers 11*a* and 11*b* are sandwiched between the lower surfaces of the leg portions 10*b*/10*c* and the upper surface of the trunk 2. The piezoelectric transducers 11*a*/11*b* convert the vibrations of the leg portions 10*b*/10*c* to the electric signal.

The electric signal is amplified, and the amplified electric signal passes through a filter circuit for producing an analog tone signal. The analog tone signal is supplied to a speaker system. However, if the analog tone signal is directly supplied to the speaker system, the audience feels the tones flat. This is because of the fact that the prior art electric violin does not have any resonator. The vibrations of the leg portions 10*b*/10*c* do not contain any reverb produced by the resonator. In order to impart the reverb to the tones, the amplified electric signal is supplied to a digital signal processor in another prior art system. The digital signal processor processes the electric signal for imparting the reverberation components to the electric signal, and, thereafter, the electric signal is supplied from the digital signal processor to the speaker system.

The first problem inherent in the prior art electric violin is poor promptitude in following up the bowing. In detail, the piezoelectric transducers 11*a*/11*b* are liable to respond to the transverse vibrations indicated by arrow AR1. While the strings 7 are vibrating through the bowing, the transverse vibration components give rise to rocking motion of the bridge 10 as indicated by arrows AR2 and AR3 and vice versa. The piezoelectric transducers 11*a*/11*b* are arranged in such a manner as to be oppositely polarized. In this situation, when the leg portions 10*b*/10*c* are moved in the directions of arrows AR2/AR3, the piezoelectric transducers 11*a*/11*b* are polarized as shown in FIG. 3, and a large amount of electric charges flow.

The arrangement of piezoelectric transducers 11*a*/11*b* is less desirable for the vertical vibration components. If the strings 7 vertically vibrate as indicated by arrow AR4 (see FIG. 4), the leg portions 10*b*/10*c* vibrate in the same direction as indicated by arrows AR5 and vice versa, and the piezoelectric transducers 11*a*/11*b* are oppositely polarized. Most of the electric charges in one piezoelectric transducer 11*a*/11*b* are canceled with the electric charges in the other piezoelectric transducer 11*b*/11*a*, and only a negligible amount current flows. Thus, the piezoelectric transducers 11*a*/11*b* hardly convert the vertical vibration components to the electric signal.

However, the bowing is not always reflected on the transverse vibrations. Although the transverse vibration components are the major factor of certain sorts of bowing, other sorts of bowing is influential in the vertical vibration components. This means that the prior art electric violin can not promptly respond to the other sorts of bowing. This is the first problem inherent in the prior art electric violin.

The second problem is poor fidelity of the tones. The piezoelectric transducers 11*a*/11*b* are corresponding to condensers in an equivalent circuit, and have strong influence on the output impedance of the pickup unit 11. If the condensers, i.e., the piezoelectric transducers have large capacitance, the out-put impedance becomes small, and the cut-off frequency is low. On the other hand, when the capacitance is small, the output impedance is large, and the cut-off frequency is high. This means that the electric signal does not contain the low frequency components. In other words, the electric tones generated from the electric signal are different from the acoustic tones produced by a corresponding acoustic bowed stringed instrument. Another drawback due to the large output impedance is a large amount of noise. The thinner the piezoelectric elements, the larger the capacitance. However, the thin piezoelectric transducers are expensive. Relatively thick piezoelectric transducers are employed in the actual prior art bowed stringed musical instruments from the viewpoint of the production cost, and this results in the poor fidelity.

The third problem is inherent in the prior art bowed stringed musical instrument of the type producing an electric tone on the basis of the plural electric signals generated by the plural vibration detectors. Although the digital signal processor can impart the reverb to the electric tones, it is impossible to express the difference in the position of sound image due to change of string bowed by the player. For example, the audience can discriminate the acoustic tones generated at a position far from them from the acoustic tones generated at another position close to them. However, even when a player changes the bowed string of the prior art bowed stringed musical instrument from one to another, the player can not discriminate the presently bowed string from the previously bowed string. In other words, the player can not notice the movement of the image through the electric tones. This is the third problem.

The problems are also encountered in other sorts of electric bowed stringed musical instruments, and are inherent to the electric bowed stringed musical instruments.

SUMMARY OF THE INVENTION

It is therefore an important object of the present invention to provide an electric bowed stringed musical instrument, which produces electric tones clear in pitch and close in timbre to acoustic tones.

It is also an important object of the present invention to provide an electric bowed stringed musical instrument, which produces electric tones clear in pitch without sacrifice of production cost.

It is another important object of the present invention to provide an electric bowed stringed musical instrument, which produces electric tones expressing change of bowed strings.

In accordance with one aspect of the present invention, there is provided an electric bowed stringed musical instrument for generating electric tones comprising a vibratory body, at least one string stretched over the vibratory body, and bowed for generating vibrations, the vibrations being propagated from the aforesaid at least one string to the vibratory body, a pickup unit connected to the vibratory body and having a first detector for converting transverse vibration components of the vibrations to a first electric signal and a second detector for converting vertical vibration components of the vibrations to a second electric signal, and a signal processing system connected to the pickup unit and including a first filter for transmitting low-frequency signal components of the first electric signal, a second filter for transmitting high-frequency signal components of the second electric signal and a signal producer connected to the first and second filters for producing a tone signal from the low-frequency signal components and the high-frequency signal components.

In accordance with another aspect of the present invention, there is provided an electric bowed stringed musical instrument for generating electric tones comprising a vibratory body, at least one string stretched over the vibratory body and bowed for generating vibrations, the vibrations being propagated from the aforesaid at least one string to the vibratory body, a pickup unit connected to the vibratory body and including plural vibration-to-electric signal converters having respective parasitic capacitances and connected in parallel to a constant potential source for converting the vibrations to an electric signal, and a signal processing system connected to the plural vibration-to-electric signal converters, and producing a tone signal from the electric signal.

In accordance with yet another aspect of the present invention, there is provided an electric bowed stringed musical instrument for generating electric tones comprising a vibratory body, plural strings stretched over the vibratory body and selectively bowed for generating vibrations, the vibrations being propagated from the plural strings to the vibratory body, a pickup unit connected to the vibratory body and including plural vibration-to-electric signal converters each different in distance to the plural strings, the vibratory body decaying the vibrations propagated from the bowed string or strings to the plural vibration-to-electric signal converters depending upon the distances between the bowed string or strings and the plural vibration-to-electric signal converters so that the vibration-to-electric signal converters generates electric signals differently influenced by the bowed string or strings, and a signal processing system connected to the plural vibration-to-electric signal converters, and separately producing tone signals from the electric signals.

BRIEF DESCRIPTION OF THE DRAWINGS

The features and advantages of the electric bowed stringed musical instrument will be more clearly understood from the following description taken in conjunction with the accompanying drawings, in which FIG. 15 is a front view showing the fourth modification of the electric violin according to the present invention, FIG. 16 is a front view showing the structure of another electric violin according to the present invention.

DESCRIPTION OF THE PREFERRED EMBODIMENTS

First Embodiment

Figure 5:
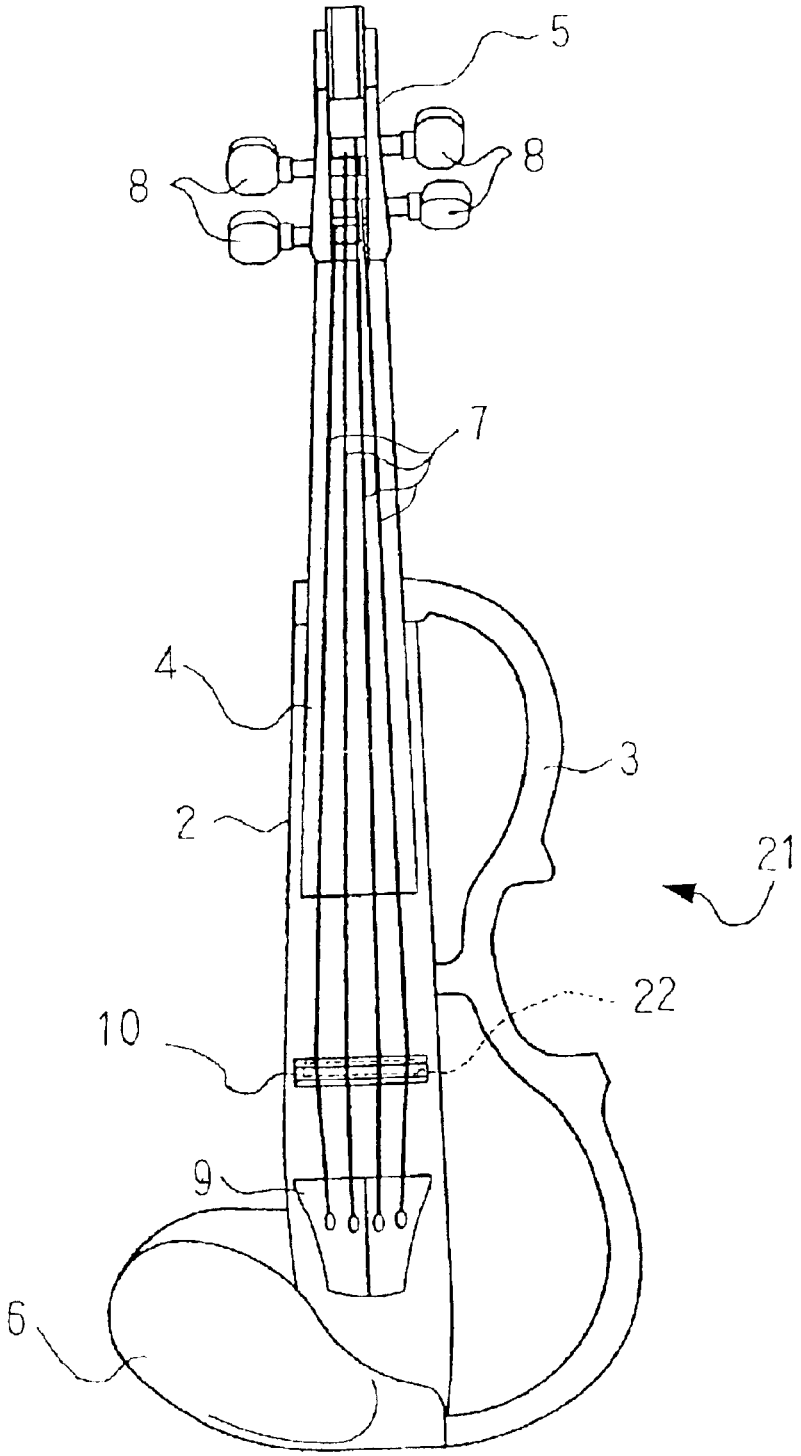
FIG. 5 is a plan view showing an electric violin according to the present invention.

Referring to FIG. 5, an electric violin 21 embodying the present invention largely comprises a trunk, a frame body, a fingerboard, a peg box, a chin rest, strings, pegs, a tailpiece, a bridge and a pickup unit 22. The trunk, frame body, fingerboard, peg box, chin rest, strings, pegs, tailpiece and bridge are similar to those of the prior art bowed stringed musical instrument, and are labeled with the references designating the corresponding component parts without detailed description.

Figure 6:
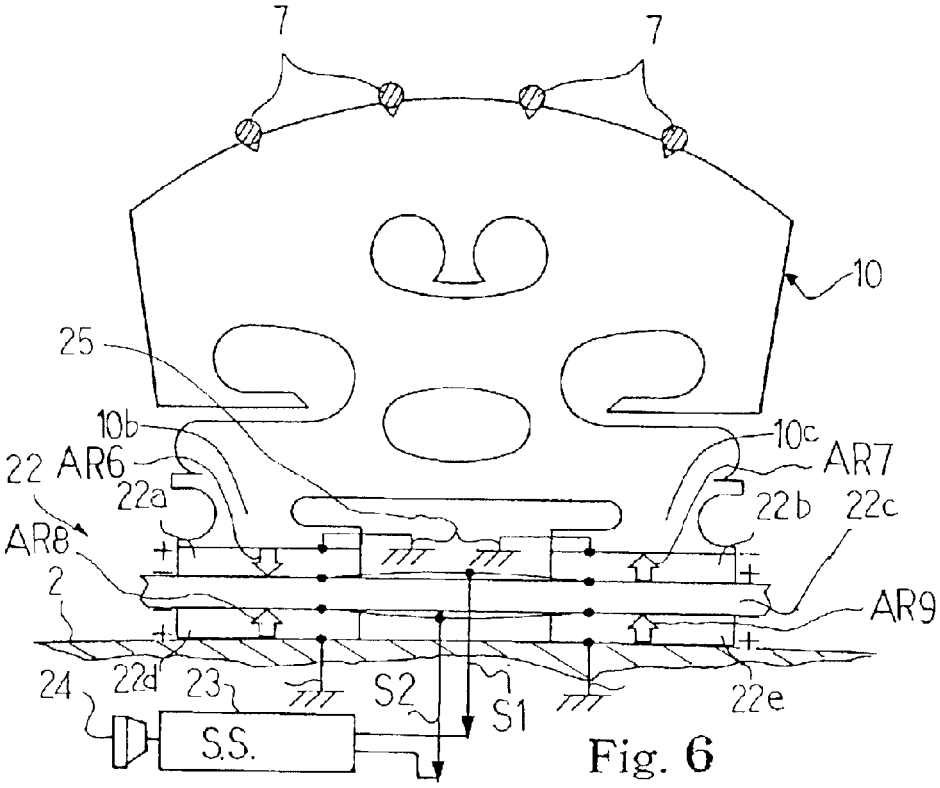
FIG. 6 is a front view showing a pickup unit incorporated in the electric violin.

FIG. 6 shows the pickup unit 22. The pick up unit 22 is provided between the leg portions 10*b*/10*c* of the bridge 10 and the upper surface of the trunk 2. The pickup unit 22 converts not only the transverse vibration components but also vertical vibration components, which are perpendicular to the transverse vibration components on the cross sections of the strings 7, to electric signals S1 and S2. The electric signals S1/S2 are supplied to a signal processing system 23, and an analog tone signal is supplied to a speaker system 24 for generating electric tones.

The pickup unit 22 includes a pair of piezoelectric transducers 22*a*/22*b* for detecting the transverse vibration components, an insulating layer 22*c* and another pair of piezoelectric transducers 22*d*/22*e* for detecting the vertical vibration components. The pairs of piezoelectric transducers 22*a*/22*b* and 22*d*/22*e* have a thin plate-like configuration. The pair of piezoelectric transducers 22*d*/22*e* are provided on the upper surface of the trunk 2, and is converted with the insulating layer 22*c*. The pair of piezoelectric transducers 22*a*/22*b* is provided on the insulating layer 22*c*, and are held in contact with the reverse surfaces of the leg portions 10*b*/10*c*. Thus, the stack of pair of piezoelectric transducers 22*d*/22*e*, insulating layer 22*c* and pair of piezoelectric transducers 22*a*/22*b* is provided between the upper surface of the trunk 2 and the leg portions 10*b*/10*c* of the bridge 10. The insulating layer 22*c* isolates the pair of piezoelectric transducers 22*a*/22*b* from the pair of piezoelectric transducers 22*d*/22*e*.

The piezoelectric transducers 22*a*/22*b* are oppositely polarized as indicated by arrows AR6/AR7. Ground electrodes are provided on the upper surfaces of the piezoelectric transducers 22*a*/22*b*, and are connected to the ground 25. Signal electrodes are provided on the lower surfaces of the piezoelectric transducers 22*a*/22*b*, and the electric signal S1 representative of the transverse vibration components is output from the signal electrodes. While the bridge 10 is vibrating, the transverse vibration components give rise to the rocking motion of the bridge 10, and alternately push and pull the piezoelectric transducers 22*a*/22*b*. As a result, the positive electric charges and negative electric charges are concurrently generated on the signal electrodes and on the ground electrodes so that the electric signal S1 is taken out from the signal electrodes of the piezoelectric transducers 22*a*/22*b* without any cancellation between the positive electric charges and the negative electric charges. However, the vertical vibration components cause the piezoelectric transducers 22*a*/22*b* to oppositely generate the positive electric charges and negative electric charges on the signal electrodes and on the ground electrodes. The positive electric charges of the piezoelectric transducer 22*a* are canceled with the negative electric charges of the other piezoelectric transducer 22*b* and vice versa. Thus, the piezoelectric transducers 22*a*/22*b* hardly detect the vertical vibration components.

On the other hand, the piezoelectric transducers 22*d*/22*e* are polarized in the same direction as indicated by arrows AR8/AR9. Signal electrodes are provided on the upper surfaces of the piezoelectric transducers 22*d*/22*e*, and ground electrodes are formed on the lower surfaces of the piezoelectric transducers 22*d*/22*e*. The transverse vibration components cause the piezoelectric transducers 22*d*/22*e* to oppositely generate the positive electric charges and negative electric charges on the ground electrodes and on the signal electrodes. For this reason, the positive electric charges of the piezoelectric transducer 22*d* are canceled with the negative electric charges of the other piezoelectric transducer 22*e* and vice versa. This means that the piezoelectric transducers 22*d*/22*e* hardly convert the transverse vibration components to an electric signal. On the other hand, while the vertical vibration components are being exerted on the piezoelectric transducers 22*d*/22*e*, the positive electric charges and negative electric charges are concurrently generated on the signal electrodes and ground electrodes and vice versa. The electric charges are taken out from the piezoelectric transducers 22*d*/22*e* as the electric signal S2.

Figure 7:
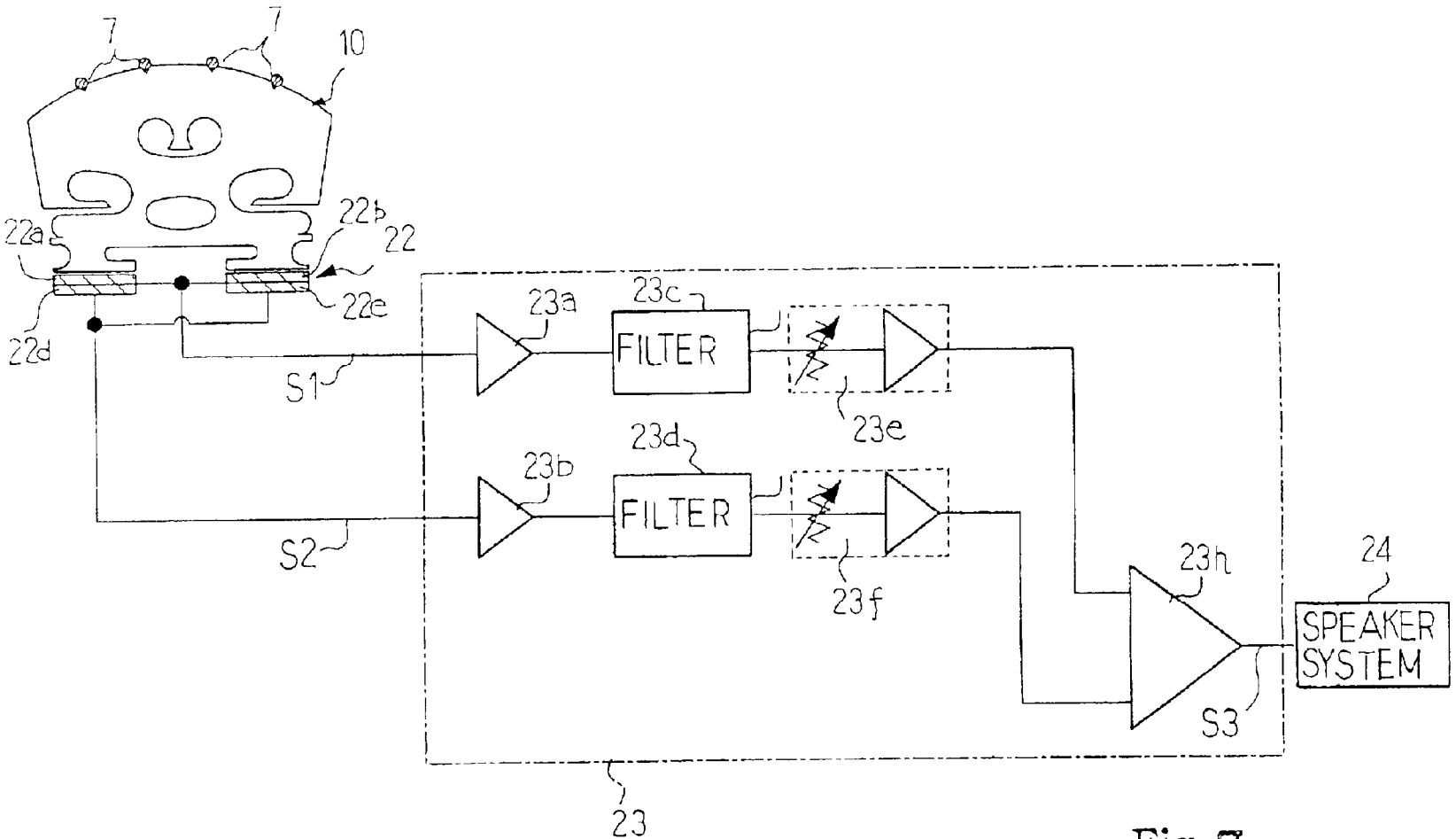
FIG. 7 is a circuit diagram showing the system configuration of a signal processing system for the electric violin.

FIG. 7 shows the signal processing system 23. The signal processing system 23 includes pre-amplifiers 23*a*/23*b*, filters 23*c*/23*d*, power amplifiers 23*e*/23*f* and an adder 23*h*. The signal electrodes of the piezoelectric transducers 22*a*/22*b* are connected to the pre-amplifier 23*a*, and the signal electrodes of the other piezoelectric transducers 22*d*/22*e* are connected to the other pre-amplifier 23*b*. The electric signal S1 representative of the transverse vibration components is supplied to the pre-amplifier 23*a*, and the preamplifier 23*a* carries out the tone-control, balance-control and so forth on the electric signal S1. On the other hand, the electric signal S2 representative of the vertical vibration components is supplied to the other pre-amplifier 23*a*, and the pre-amplifier 23*a* also carries out the tone-control, balance control and so forth on the electric signal S2.

Figure 8A:
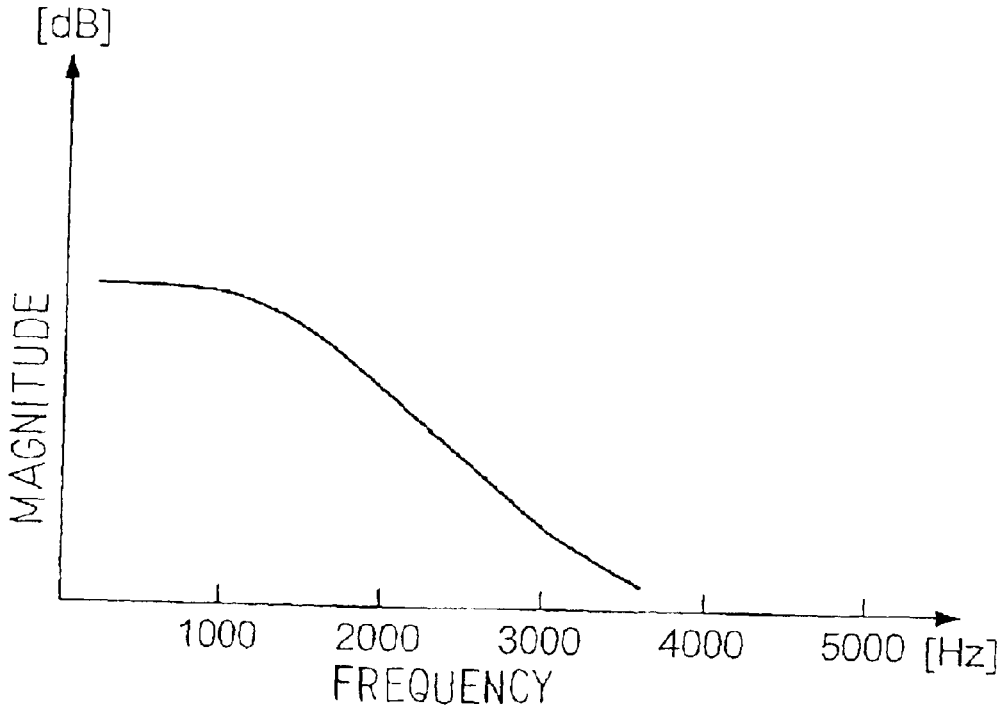
FIGS. 8A and 8B are graphs showing the frequency characteristics of filters incorporated in a signal processing system of the electric violin.

The pre-amplifiers 23*a*/23*b* are connected in parallel to the filters 23*c*/23*d*. The filter 23*a* is different in characteristics from the other filter 23*b*. The filter 23*a* is designed in such a manner as to transmit low frequency signal components and attenuate high-frequency components as shown in FIG. 8A. On the other hand, the filter 23*b* is designed in such a manner as to transmit high frequency signal components and attenuate the low frequency signal components. Thus, the filter 23*a* and the other filter 23*b* are categorized in the low-pass filter and the high-pass filter, respectively.

The filters 23*c*/23*d* are connected to the power amplifiers 23*e*/23*f*, respectively, and the electric signals S1 and S2 are supplied from the filters 23*c*/23*d* to the power amplifiers 23*e*/23*f*, respectively. The power amplifiers 23*e*/23*f* are independently regulated to values of amplification factor. The power amplifiers 23*e*/23*f* amplify the electric signals S1/S2 at the given values of amplification factor, and supply the amplified signals S1/S2 to the adder 23*h*. The adder 23*h* adds the amplitude of the signal S1 to the amplitude of the signal S2, and produces the analog tone signal S3. The analog tone signal S3 is supplied from the adder 23*h* to the speaker system 24 for generating the electric tones. A headphone is incorporated in the speaker system 24, and the player may hear the electric tones through the headphone without disturbance to the neighborhood.

Figure 9A:
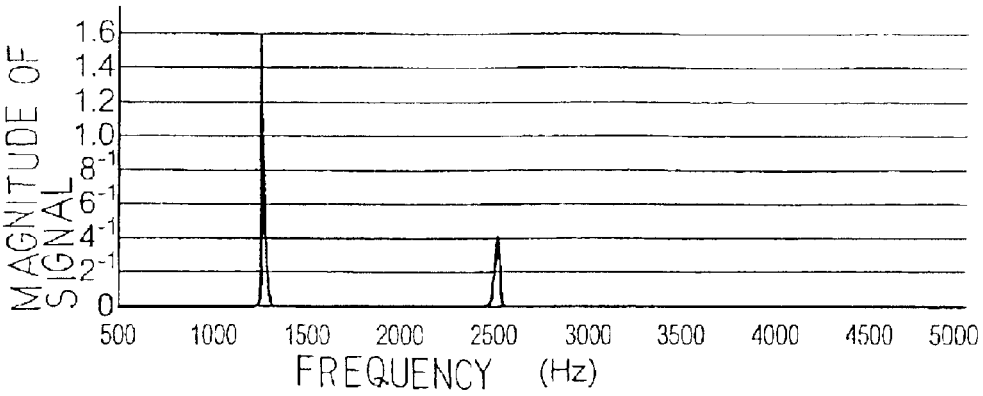
FIGS. 9A and 9B are graphs showing the frequency spectrums observed in electric signals produced from transverse and vertical vibration components of an acoustic violin.
Figure 9B:
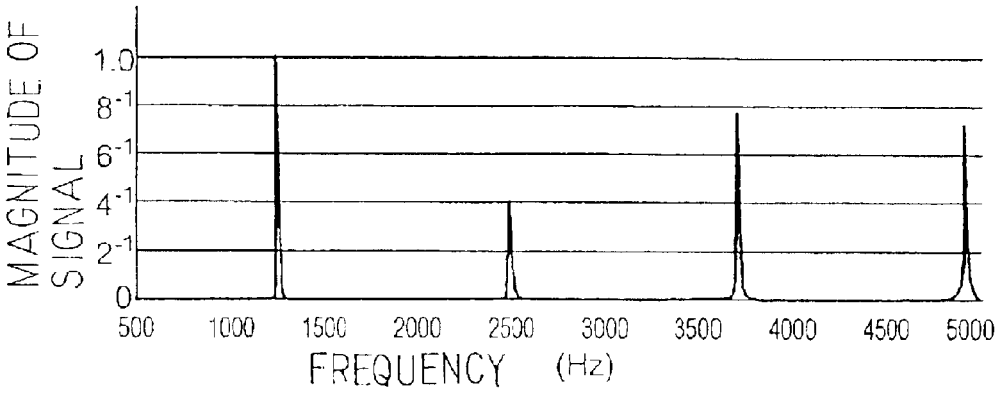

The reason for the frequency characteristics of the filters 23*c*/23*d* is described hereinafter in detail. The present inventor bowed the E-string of an acoustic violin, and measured the frequency spectrum. While the E-string of the acoustic violin was being bowed, the transverse vibration components exhibited the frequency spectrum shown in FIG. 9A, and the vertical vibration components exhibited the frequency spectrum shown in FIG. 9B.

The transverse vibration components were observed in the frequency range equal to or less than 2500 Hz, and the high-frequency components were negligible. The transverse vibration components represented the fundamental tone and low-order harmonic. However, the timbre was dominated by the high-order harmonics. It was natural that the electric tones generated through the prior art electric violin had been poor in similarity to the acoustic tones generated through acoustic violins.

On the other hand, the vertical vibration components had the frequency spectrum much wider than that of the transverse vibration components. The vertical vibration components expressed the high-order harmonics as well as the fundamental tone. However, the difference between the magnitude of signal component representative of the fundamental tone and the magnitude of signal components representative of the harmonic tones is not so large as the difference observed in the transverse vibration components. The scale for the magnitude of signal in FIG. 9A was same as that shown in FIG. 9B. This meant that the vertical vibration components were less influential to the fundamental tone of the electric tones. In fact, when the electric tones were generated from only the vertical vibration components, the electric tones did not have clear pitches, and the audience felt the electric tones poor and nervous. The present inventor concluded that the high-frequency vertical vibration components were to be combined to the low-frequency transverse vibration components. The present inventor expected the electric tones generated from the combined signal to be clear, rich and close in timbre to the acoustic tones, and the electric tones met the inventor's expectation.

Figure 8B:
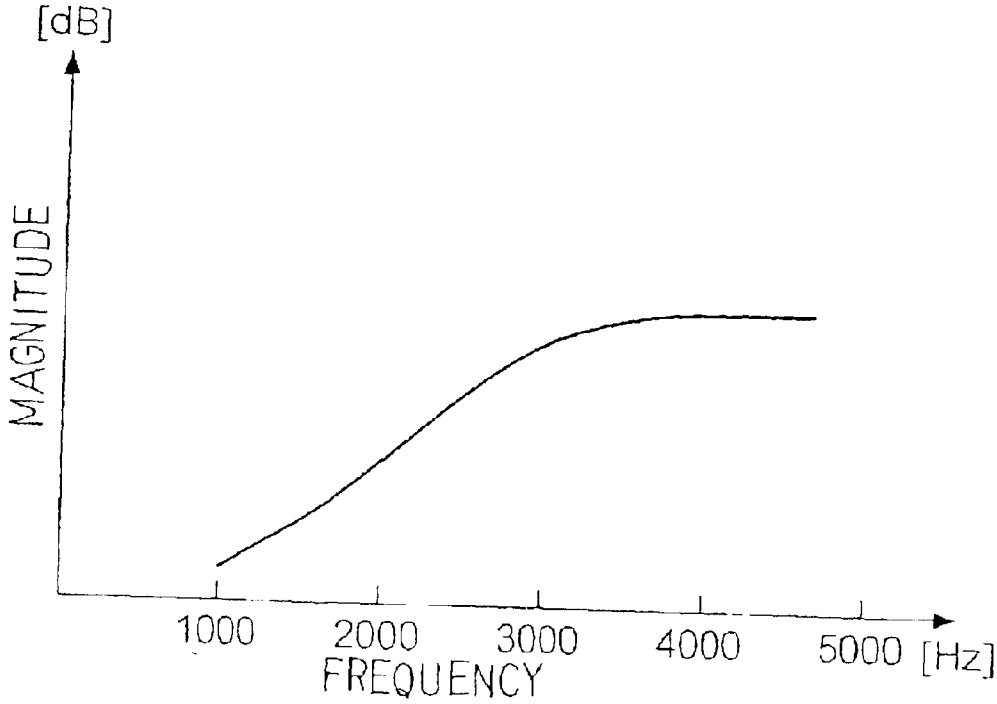

In the design work, the present inventor prepared two vibration detectors for separately converting the transverse vibration components and vertical vibration components to the electric signals S1 and S2 independent of each other, and eliminated the high-frequency signal components and the low-frequency signal components from the electric signals S1 and S2 through the filters 23*c*/23*d* before combining the two electric signals into the analog tone signal. For this reason, the frequency characteristics shown in FIGS. 8A and 8B were respectively given to the filters 23*c*/23*d*.

Assuming now that a player is bowing the strings 7, the vibrations are transmitted from the vibrating strings 7 to the bridge 10. The vibrations are propagated through the leg portions to the pair of piezoelectric transducers 22*a*/22*b*, and are further propagated through the insulating layer 22*c* to the pair of piezoelectric transducers 22*d*/22*e*. Although the vibrations contain both of the transverse vibration components and the vertical vibration components, the transverse vibration components are converted to the electric signal S1 through the pair of piezoelectric transducers 22*a*/22*b*, and the vertical vibration components are converted to the electric signal S2 by means of the other pair of piezoelectric transducers 22*d*/22*e*. The electric signals S1 and S2 are supplied in parallel through the pre-amplifiers 23*a*/23*b* to the filters 23*c*/23*d*.

The filter 23*c* eliminates the high-frequency signal components from the electric signal S1, and supplies the electric signal S1, which is representative of the low-frequency transverse vibration components equivalent to the fundamental tone and low-order harmonic, through the power amplifier 23*e* to the adder 23*h*. On the other hand, the filter 23*d* eliminates the low-frequency signal components from the electric signal S2, and supplies the electric signal S2, which is representative of the high-frequency vertical vibration components equivalent to the high-order harmonics, through the power amplifier 23*f* to the adder 23*h*.

The adder 23*h* combines the electric signal into the analog tone signal S3. The analog tone signal S3 contains the low-frequency signal components representative of the fundamental tone and low-order harmonic and the high-frequency signal components representative of the high-order harmonics. The adder 23*h* supplies the analog tone signal S3 to the speaker system 24, and the electric tones, which contain the high-order harmonics as well as the fundamental tones and low-order harmonic, are radiated from the speaker system 24.

As will be understood from the foregoing description, the plural vibration detectors 22*a*/22*b* and 22*d*/22*e* independently convert plural sorts of vibration components to the electric signals S1 and S2, and signal components representative of the fundamental tone and high-order harmonics are respectively extracted from the electric signals S1 and S2 through the filters 23*c*/23*d* having different frequency characteristics. The tone signal S3 is produced from the electric signals S1/S2 after the filtering. The electric tones produced from the tone signal contain both of the fundamental tone and the high-order harmonics. As a result, the electric tones are clear in pitch and close in timbre to the corresponding acoustic tones. Thus, the electric violin 21 is effective against the first problem.

Modifications of First Embodiment

Figure 10:
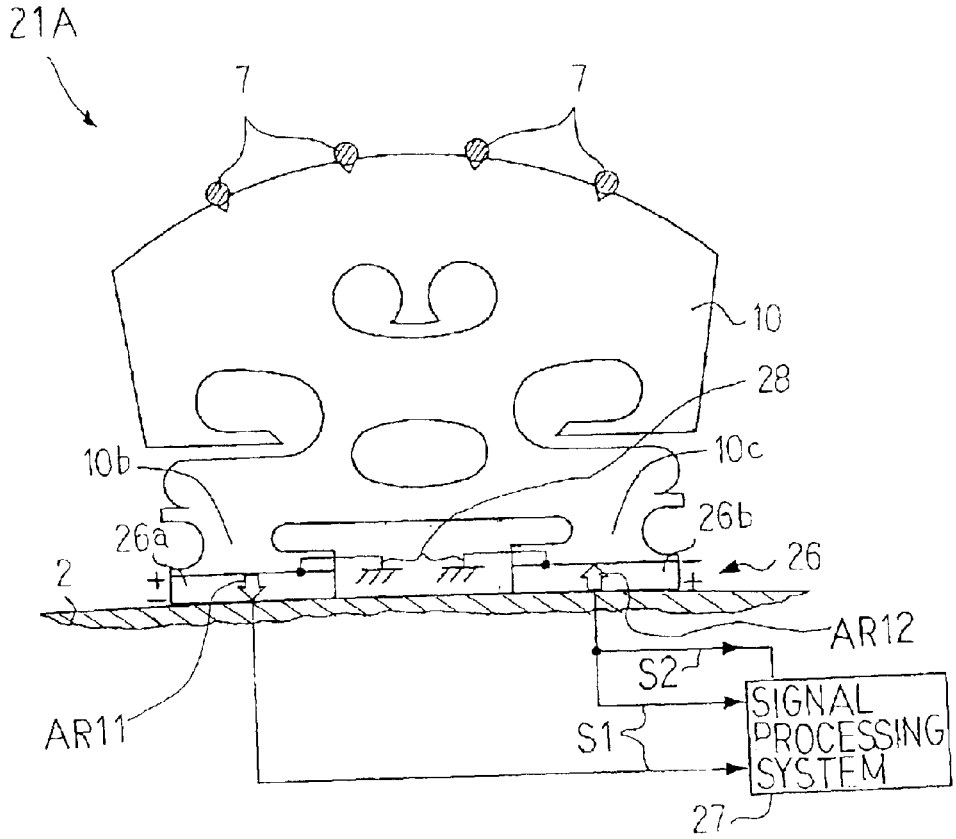
FIG. 10 is a front view showing a pickup unit incorporated in the first modification of the electric violin according to the present invention.

The plural sorts of vibration components are detectable through other sorts of pickup units. FIG. 10 shows the first modification 21A of the electric violin 21. The electric violin is similar to the electric violin 21 except a pickup unit 26. For this reason, the other component parts of the electric violin 21A are labeled with the references designating the corresponding component parts of the electric violin 21 without detailed description.

The pickup unit 26 is implemented by only one pair of thin piezoelectric transducers 26*a*/26*b*. The piezoelectric transducers 26*a*/26*b* are provided between the leg portions 10*b*/10*c* and the upper surface of the trunk 2. The piezoelectric transducers 26*a*/26*b* are oppositely polarized as indicated by arrows AR11 and AR12. Signal electrodes are formed on the lower surfaces of the piezoelectric transducers 26*a*/26*b*, and are connected to a signal processing system 27. Ground electrodes are formed on the upper surfaces of the piezoelectric transducers 26*a*/26*b*, and are connected to the ground 28.

Both of the piezoelectric transducers 26*a*/26*b* serve as a vibration detector for the transverse vibration components, and only the piezoelectric transducer 26*b* serves as a vibration detector for the vertical vibration components. When the transverse vibration components are exerted on the piezoelectric transducers 26*a*/26*b*, the positive electric charges are concurrently alternately generated on the signal electrodes and ground electrodes, and the negative electric charges are concurrently alternately generated on the ground electrodes and signal electrodes. As a result, the total amount of electric charges flow as the electric signal. On the other hand, when the vertical vibration components are applied to the piezoelectric transducers 26*a*/26*b*, the positive electric charges and negative electric charges are oppositely generated on the signal and ground electrodes. In order to prevent the positive electric charges on one signal electrode from cancellation with the negative electric charges on the other signal electrode, the electric signal S2 is taken out form only one signal electrode of the piezoelectric transducer 26*b*. The flow of electric charges produced by the piezoelectric transducer 26*a* is labeled with y2. The flow of electric charges produced by the piezoelectric transducer 26*b* for the electric signal S1 is labeled with y1, and the flow of electric charges for the electric signal S2 is labeled with t.

Figure 11:
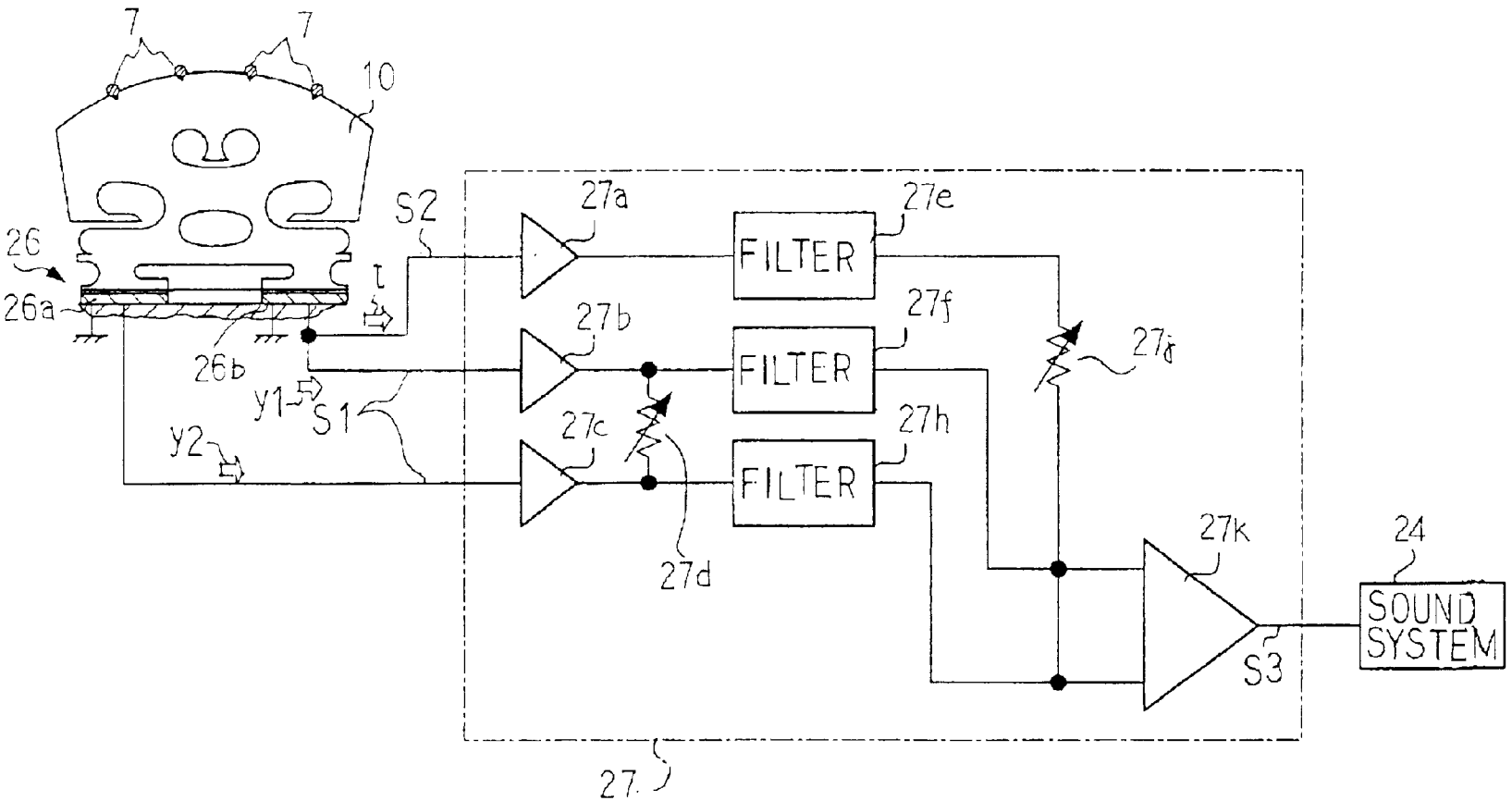
FIG. 11 is a circuit diagram showing the system configuration of a signal processing system connected to the pickup unit.

FIG. 11 shows the signal processing system 27, and comprises preamplifiers 27*a*/27*b*/27*c*, a variable-gain amplifier 27*d*, filters 27*e*/27*f*/27*h*, a variable-gain amplifier 27*j* and an adder 27*k*. The signal electrode of the piezoelectric transducer 26*b* is connected to the pre-amplifiers 27*a*/27*b*, and the signal electrode of the other piezoelectric transducer 26*a* is connected to the pre-amplifier 27*c*. The pre-amplifier 27*a* directly supplies the flow of electric charges t to the filter 27*e*, and the pre-amplifiers 27*b*/27*c* supplies the flows of electric charges y1/y2 to the filters 27*f*/27*h* through the regulation by means of the variable-gain amplifier 27*d*. The variable-gain amplifier 27*d* amplifies the electric signal S1, i.e., the flows of electric charges y1/y2 at a given amplification factor.

Figure 12A:
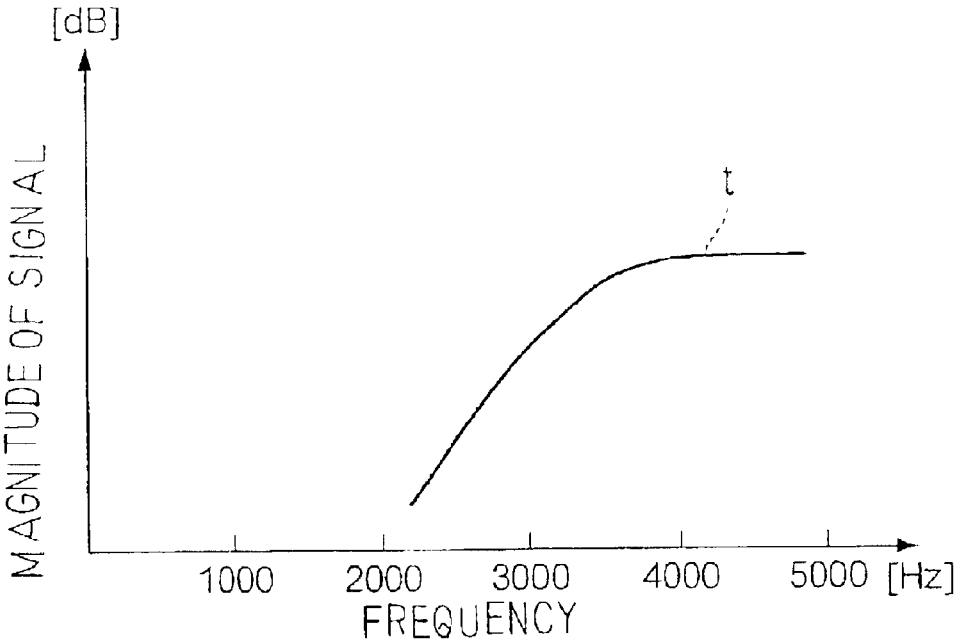
FIGS. 12A and 12B are graphs showing the frequency characteristics of filters incorporated in the signal processing system.
Figure 12B:
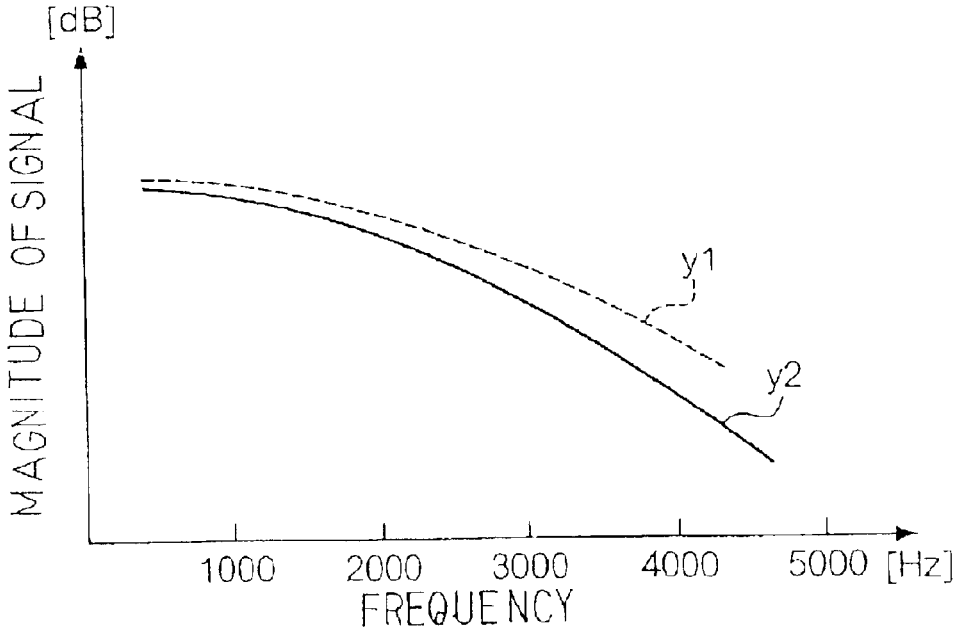

The filters 27*e*/27*f*/27*h* have frequency characteristics different form one another as shown in FIGS. 12A and 12B The filter 27*e* has the frequency characteristics shown in FIG. 12A. The filter 27*e* attenuates the low-frequency signal component from the electric signal S2, and transmits the high-frequency signal components to the variable-gain amplifier 27*j*. On the other hand, the filters 27*f*/27*h* have the frequency characteristics indicated by plots y1 and y2 in FIG. 12B. The filters 27*f*/27*h* transmit the low-frequency signal components to the adder 27*k*, and attenuate the high-frequency signal components from the flows of electric charges y1/y2. However, the filter 27*f* has the pass band higher in frequency than the pass band of the other filter 27*h*. This is because of the fact that the high-frequency vibrations reach the piezoelectric transducer 26*b* more than the other piezoelectric transducer 26*a*.

In FIG. 11, the leftmost string 7 is assigned to the lowest register, and low-pitched tones are generated from the leftmost string 7. On the other hand, the right most string 7 is assigned to the highest register, and high-pitched tones are generated from the rightmost string 7. The piezoelectric transducer 26*a* is closer to the string 7 for the lowest register than the other piezoelectric transducer 26*b*, and the low-frequency vibrations reach the piezoelectric transducer 26*a* more than the other piezoelectric transducer 26*b*. On the other hand, the piezoelectric transducer 26*b* is closer to the string 7 for the highest register than the piezoelectric transducer 26*a*, and the high-frequency vibrations reach the piezoelectric transducer 26*b* more than the piezoelectric transducer 26*a*. Accordingly, the flow of electric charges y1 contains the high-frequency signal components more than those of the other flow of electric charges y2. In order to transmit the high-frequency signal components, the frequency characteristics of the filter 27*f* has the pass band higher in frequency than the pass band of the other filter 27*h*. Thus, the filters 27*f*/27*h* are independently adjusted to the most preferable frequency characteristics.

The electric signal S2 is amplified at a predetermined amplification factor by means of the variable-gain amplifier 27*j* so that the electric signal S2 has the magnitude as large as that of the electric signal S1. Although the electric signal S2 is generated from only one piezoelectric transducer 26*b*, the electric signal S2 is balanced with the other electric signal S1.

The filters 27*f*/27*h* supply the flows of electric charge y1/y2 directly to the adder 27*k*, and the variable-gain amplifier 27*j* supplies the flow of electric charges t to the adder 27*k*. The adder 27*h* adds the electric signal S1 to the electric signal S2 for generating the analog tone signal S3. The analog tone signal S3 contains the low-frequency signal components representative of the fundamental tone and low-order harmonic as well as the high-frequency signal components representative of the high-order harmonics. The analog tone signal is supplied to the speaker system 24, and the electric tones are radiated from the speaker system 24. The electric tones are also clear in pitch and close in timbre to the acoustic violin tones.

Thus, the first modification 21A achieves all the advantages of the electric violin 21. Only one pair of piezoelectric transducers 26*a*/26*b* serves as the vibration detector for the transverse vibration components and the vibration detector for the vertical vibration components, and the pickup unit 26 becomes simpler than the pickup unit 22. The frequency characteristics of the filters 27*f*/27*h* are appropriately adjusted to the frequency ranges of the vibrations to be detected so that the fundamental tones becomes clearer.

Figure 13:
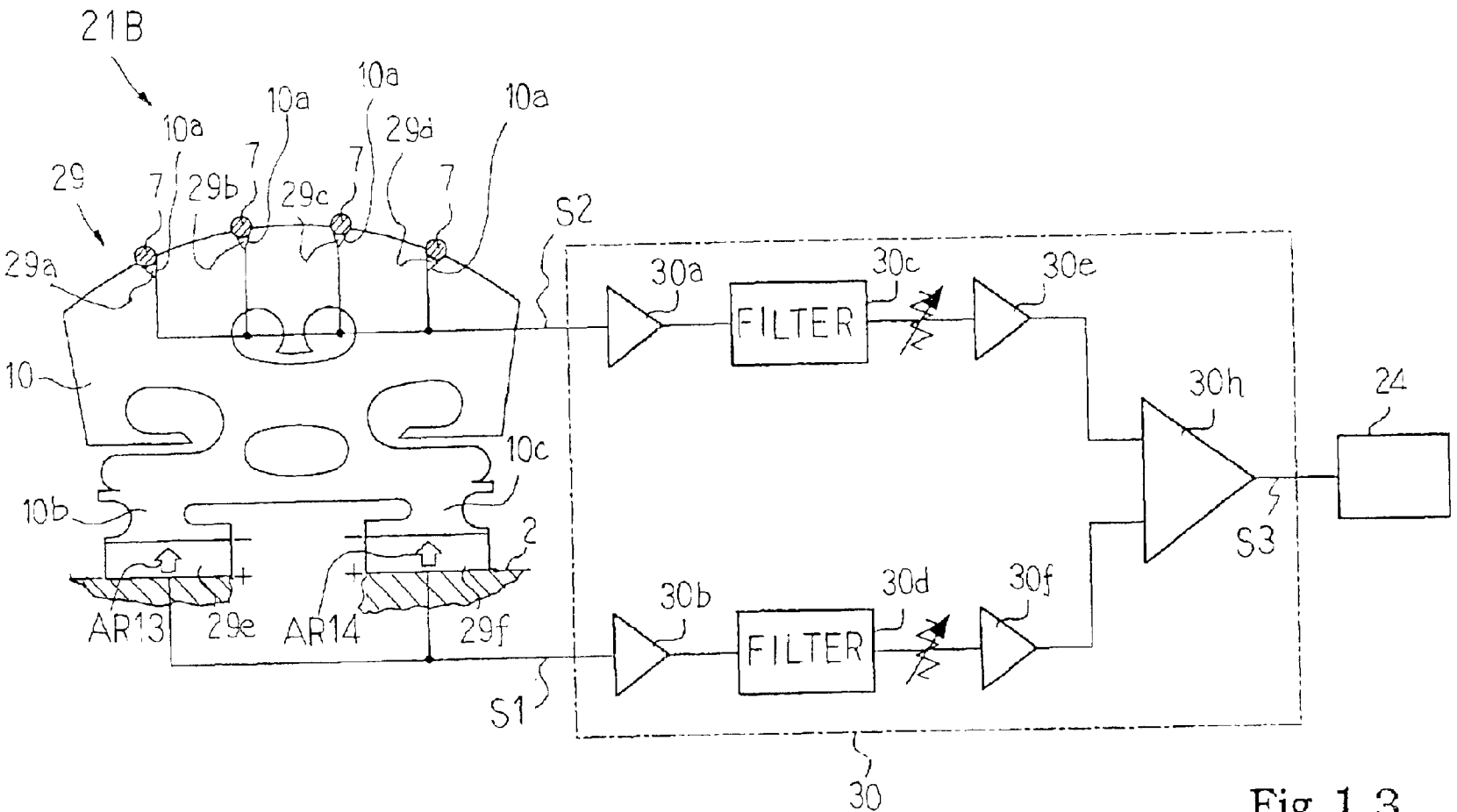
FIG. 13 is a view showing the second modification of the electric violin according to the present invention.

FIG. 13 shows the second modification 21B of the electric violin 21. The electric violin 21B is similar to the electric violin 21 except a pickup unit 29. For this reason, the other component parts of the electric violin 21B are labeled with the references designating the corresponding component parts of the electric violin 21 without detailed description.

The pickup unit 29 comprises four piezoelectric transducers 29*a*/29*b*/29*c*/29*d* and a pair of piezoelectric transducers 29*e*/29*f*. The piezoelectric transducers 29*a*/29*b*/29*c*/29*d* are received in the notches 10*a*, and converts vibrations of the upper portion of the bridge 10 to an electric signal S2. The vibrations of the upper portion are dominated by low-frequency vibrations representative of fundamental tones and low-order harmonics, and the piezoelectric transducers 29*a*/29*b*/29*c*/29*d* convert the low-frequency vibrations to the electric signal S2. The piezoelectric transducers 29*a*/29*b*/29*c*/29*d* supply the electric signal S2 to a signal processing system 30.

On the other hand, the piezoelectric transducers 29*e*/29*f* are provided between the leg portions 10*b*/10*c* and the upper surface of the trunk 2, and are polarized in the same direction indicated by the arrows AR13/AR14. For this reason, the pair of piezoelectric transducers 29*e*/29*f* converts the vertical vibration components to an electric signal S1. The pair of piezoelectric transducers 29*e*/29*f* supplies the electric signal S1 to a signal processing system 30.

The signal processing system 30 includes pre-amplifiers 30*a*/30*b*, filters 30*c*/30*d*, power amplifiers 30*e*/30*f* and an adder 30*h*. The electric signals S2 and S1 are supplied through the pre-amplifiers 30*a* and 30*b* to the filters 30*c* and 30*d*, respectively. The filters 30*c* and 30*d* are different in frequency characteristics from one another. The filter 30*c* transmits low-frequency signal components to the power amplifier 30*e*, and attenuates high-frequency signal components from the electric signal S2. Thus, the filter 30*c* has the frequency characteristics shown in FIG. 8A. On the other hand, the filter transmits high-frequency signal components to the power amplifier 30*f*, and attenuates low-frequency signal components from the electric signal S1. The filter 30*f* has the frequency characteristics shown in FIG. 8B.

The signals S2/S1 are amplified at predetermined values of amplification factor in the power amplifiers 30*e*/30*f*, and the power amplifiers 30*e*/30*f* supply the electric signals S2/S1 to the adder 30*h*. The adder 30*h* produces an analog tone signal S3 from the signals S2/S1, and supplies the analog tone signal S3 to the speaker system 24. The analog tone signal S3 contains the low-frequency signal components representative of the fundamental tones and low-order harmonics thereof and the high-frequency signal components representative of the high-order harmonics so that the electric tones are clear in pitch and close in timbre to the acoustic violin tones.

Figure 14:
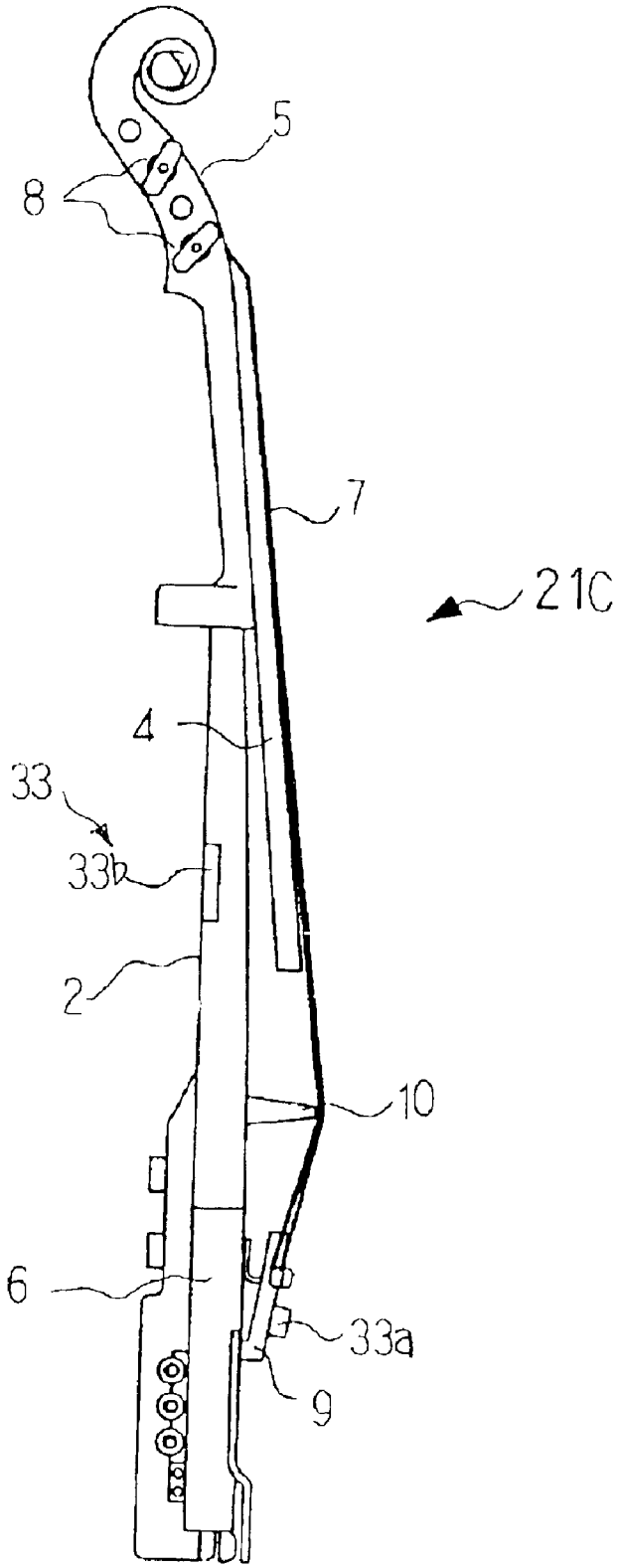
FIG. 14 is a side view showing the third modification of the electric violin according to the present invention.
Figure 1:
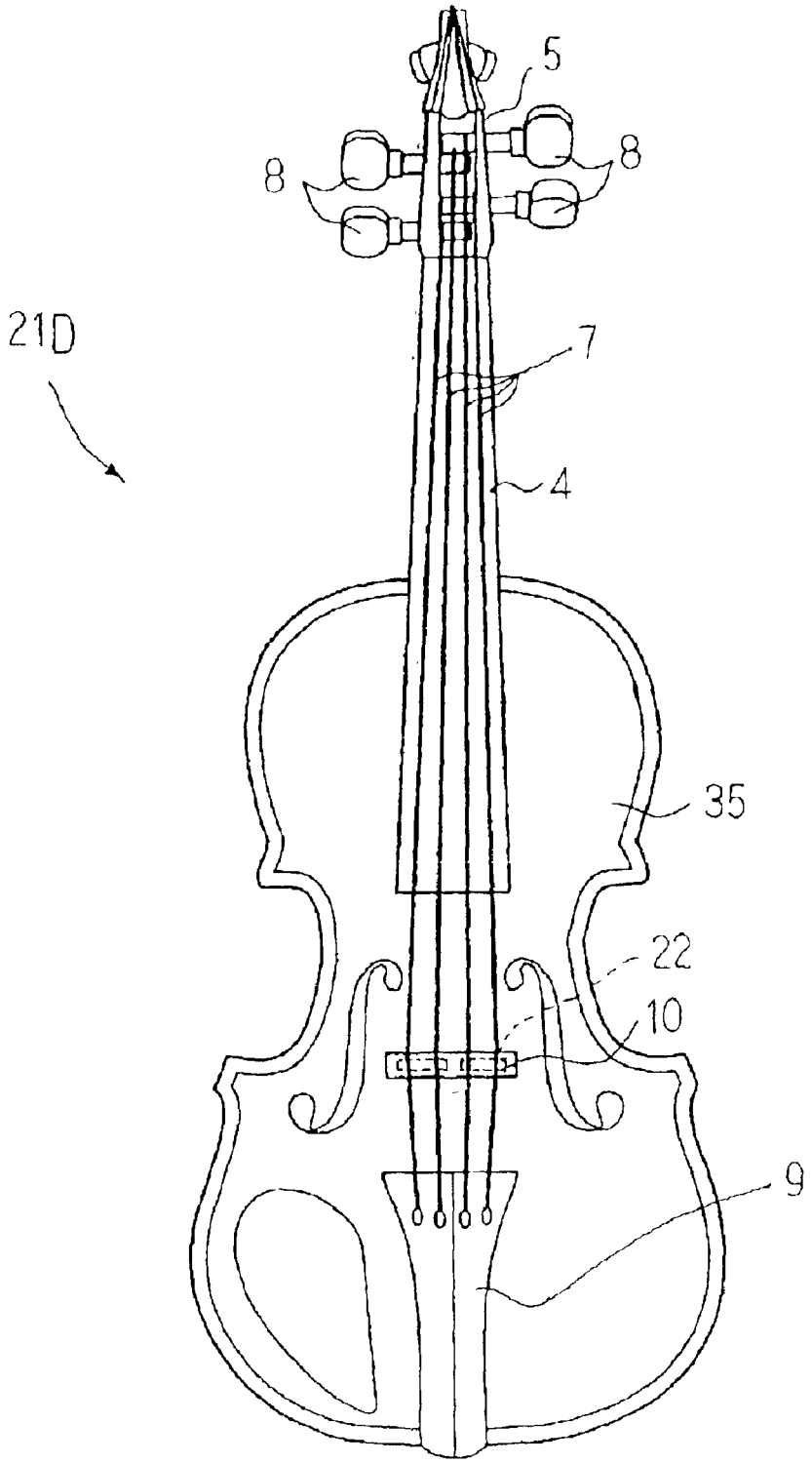
Figure 1:
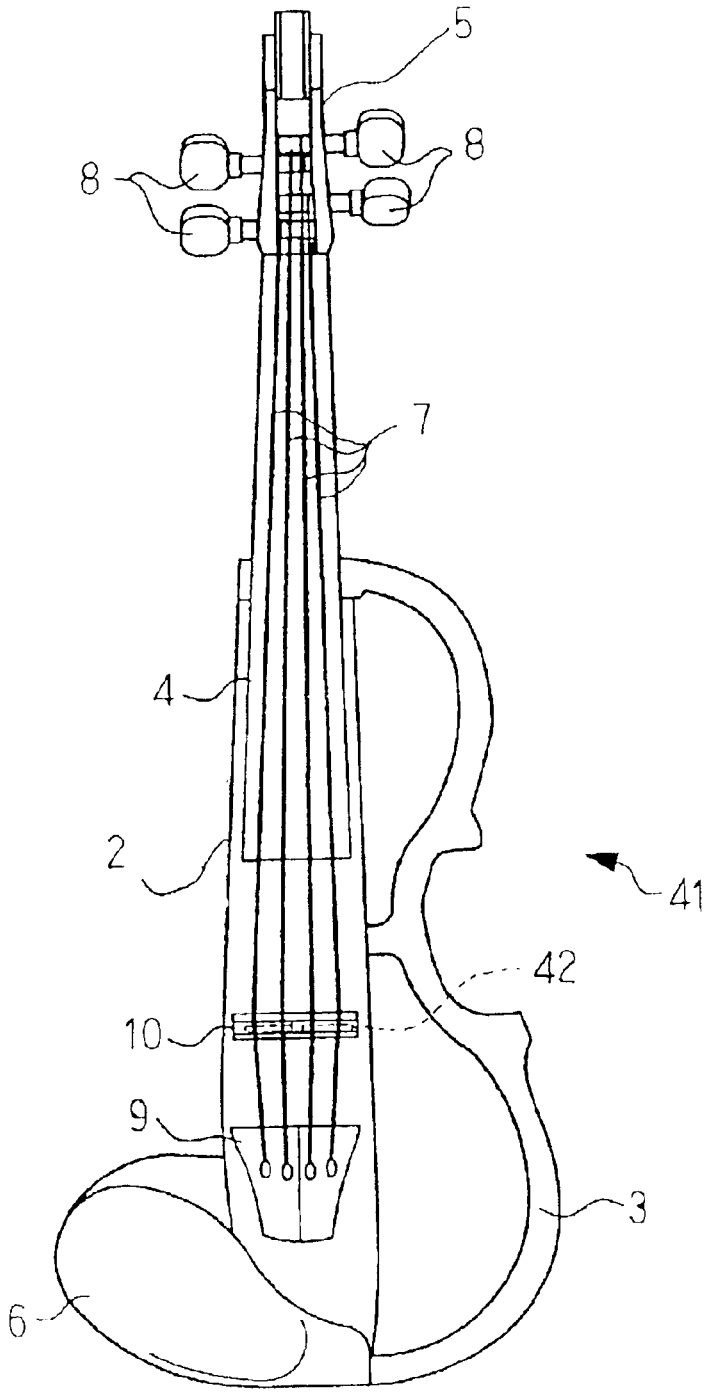

FIG. 14 shows the third modification 21C of the electric violin 21. The electric violin 21C is similar to the electric violin 21 except a pickup unit 33. For this reason, other component parts of the electric violin 21C are labeled with the same references designating corresponding part of the electric violin 21.

The pickup unit 33 includes two vibration detectors 33*a* and 33*b*. The vibration detector 33*a* is a microphone attached to the tailpiece 9, and the other vibration detector 33*b* is another microphone attached to the trunk 2. While a player is bowing, the vibrations are propagated from the strings 7 to the trunk 2 as well as the tailpiece 9. The vibrations give rise to variation of sound pressure, and the microphones 33*a*/33*b* converts the sound pressure to electric signals S1/S2. The electric signals S1/S2 may be supplied to the signal processing system 30. (See FIG. 13) The electric signal S1 generated through the microphone 33*a* contains high-frequency signal components representative of high-order harmonics, and the electric signal S2 generated through the microphone 33*b* contains low-frequency signal components representative of fundamental tones and low-order harmonics thereof. The electric signal S1 is supplied through the pre-amplifier 30*b* to the filter 30*d*, and the other electric signal S2 is supplied through the pre-amplifier 30*a* to the filter 30*c*. After the filtering, the electric signals S1/S2 are amplified by means of the power amplifiers 30*e*/30*f*, and an analog tone signal S3 is produced from the electric signals S1/S2. The analog tone signal S3 contains the low-frequency signal components representative of the fundamental tones and low-order harmonics thereof and the high-frequency signal components representative of the high-order harmonics so that the electric tones are clear in pitch and close in timbre to the acoustic violin tones.

FIG. 15 is the fourth modification 21D of the electric violin 21. The electric violin 21D is categorized in the electric acoustic violin. The trunk and frame body 2/3 are replaced with a body 35 formed with a resonator. Other components are labeled with the same references designating corresponding parts of the electric violin 21. The pickup unit 22 is provided between the legs of the bridge 10 and the upper surface of the body 35. The electric acoustic violin achieves all the advantages of the electric violin 21.

In the electric violins 21, 21A, 21B and 21C, the trunk 2, frame body 3, fingerboard 4, peg box 5, chin rest 6, tailpiece 9 and bridge 10 as a whole constitute a vibratory body. In the electric acoustic violin 21D, the body 35, peg box 5, tailpiece 9 and bridge 10 as a whole constitute a vibratory body. Each of the adders 23*h*, 27*k* and 30*h* serves as a signal producer.

Second Embodiment

Referring to FIG. 16, another electric violin 41 embodying the present invention largely comprises a trunk, a frame body, a fingerboard, a peg box, a chin rest, strings, pegs, a tailpiece, a bridge and a pickup unit 42. The trunk, frame body, fingerboard, peg box, chin rest, strings, pegs, tailpiece and bridge are similar to those of the prior art bowed stringed musical instrument shown in FIG. 1, and are labeled with the references designating the corresponding component parts without detailed description.

Figure 17:
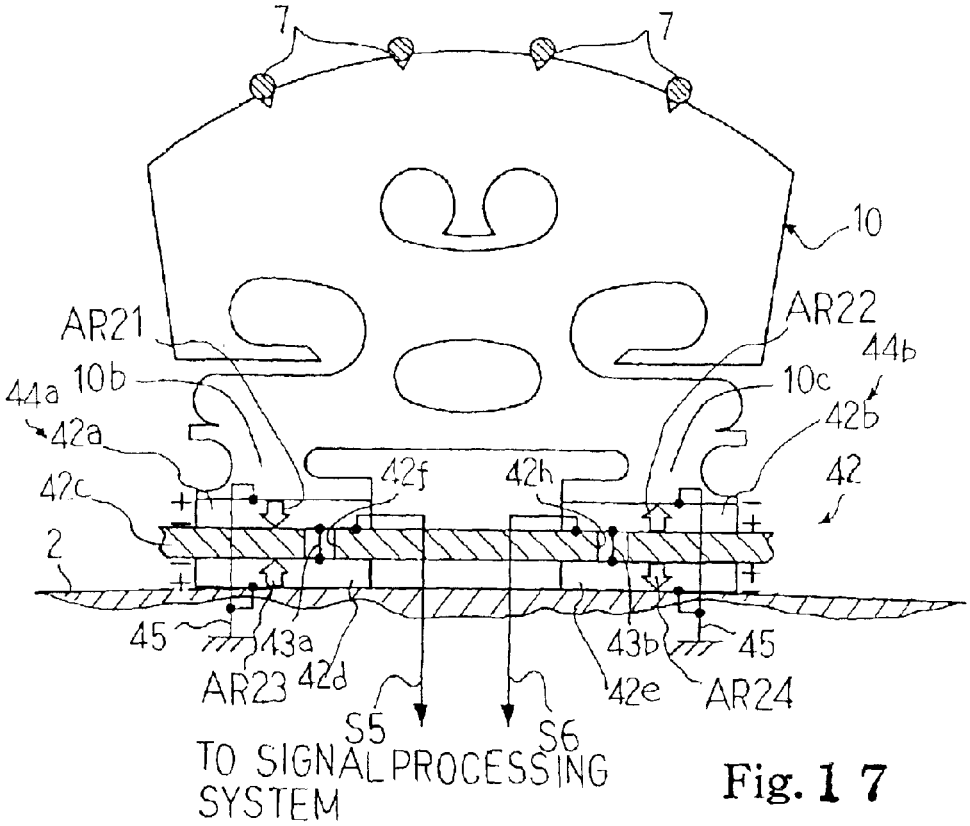
FIG. 17 is a front view showing a pickup unit incorporated in the electric violin.

FIG. 17 shows the pickup unit 42. The pick up unit 42 is provided between the leg portions 10*b*/10*c* of the bridge 10 and the upper surface of the trunk 2. The pickup unit 42 includes piezoelectric transducers 42*a*/42*b*, an insulating layer 42*c* and piezoelectric transducers 42*d*/42*e*. The piezoelectric transducers 42*a*/42*b* and 42*d*/42*e* have a thin plate-like configuration. However, the piezoelectric transducers 42*a*/42*b*/42*d*/42*e* are of the standard type, and are not expensive.

The piezoelectric transducers 42*d*/42*e* are provided on the upper surface of the trunk 2, and are converted with the insulating layer 42*c*. The piezoelectric transducers 42*a*/42*b* are provided on the insulating layer 42*c*, and are held in contact with the reverse surfaces of the leg portions 10*b*/10*c*. Thus, the stack of piezoelectric transducers 42*d*/42*e*, insulating layer 42*c* and piezoelectric transducers 42*a*/42*b* is provided between the upper surface of the trunk 2 and the leg portions 10*b*/10*c* of the bridge 10. Through-holes 42*f*/42*h* are formed in the insulating layer 42*c*. The through-hole 42*f* occupies a part of the insulting layer 42*c* between the piezoelectric transducer 42*a* and the piezoelectric transducer

42*d*, and the other through-hole 42*h* occupies another part of the insulating layer 42*c* between the piezoelectric transducer 42*b* and the piezoelectric transducer 42*e*. The piezoelectric transducer 42*a* is connected through a conductive plug 43*a* in the through-hole 42*f* to the piezoelectric transducer 42*d*, and the piezoelectric transducer 42*b* is connected through a conductive plug 43*b* in the through-hole 42*h* to the piezoelectric transducer 42*e*. Thus, the piezoelectric transducers 42*a* and 42*c* and the piezoelectric transducers 42*b* and 42*d* form the first group 44*a* and the second group 44*b*, respectively, and the first group 44*a* of piezoelectric transducers 42*a*/42*d* and the second group 44*b* of piezoelectric transducers 42*b*/42*e* convert transverse vibration components of the bridge 10 to electric signals S5/S6 as will be described hereinafter in detail.

Figure 18:
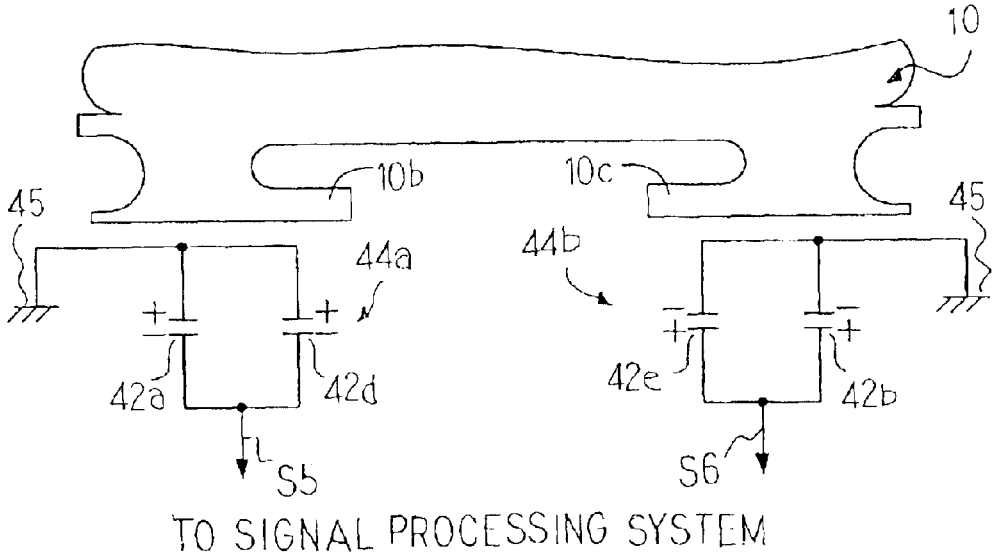
FIG. 18 is a circuit diagram showing an equivalent circuit of the pickup unit.

The piezoelectric transducer 42*a* is polarized in a direction indicated by arrow AR21, and a signal electrode and a ground electrode are formed on the lower surface and upper surface of the piezoelectric transducer 42*a*. On the other hand, the piezoelectric transducer 42*d* is polarized in the opposite direction indicated by arrow AR23, and a signal electrode and a ground electrode are formed on the upper surface and lower surface of the piezoelectric transducer 42*d*, respectively. The signal electrodes are connected through the conductive plug 43*a*, and the ground electrodes are connected to the ground 45. Thus, the piezoelectric transducers 42*a* and 42*d* are connected in parallel between the ground 45 and a signal processing system 46 as shown in FIG. 18.

The piezoelectric transducer 42*b* is polarized in the opposite direction indicated by arrow AR22, and a signal electrode and a ground electrode are formed on the lower surface and upper surface of the piezoelectric transducer 42*b*. On the other hand, the piezoelectric transducer 42*e* is polarized in the direction indicated by arrow AR24, and a signal electrode and a ground electrode are formed on the upper surface and lower surface of the piezoelectric transducer 42*e*. The signal electrodes are connected through the conductive plug 43*b*, and the ground electrodes are connected to the ground 45. Thus, the piezoelectric transducers 42*b* and 42*e* are connected in parallel between the ground 45 and the signal processing system 46.

Assuming now that a player bows the strings 7, the vibrating strings 7 give rise to rocking motion of the bridge 10, and the leg portions 10*b* and 10*c* are repeatedly oppositely moved. Namely, when the leg portion 10*b* is moved upwardly, the other leg portion 10*c* is moved downwardly. As described hereinbefore, the piezoelectric transducer 42*a*/42*e* are polarized oppositely to the piezoelectric transducers 42*b*/42*d* so that positive and negative electric charges are concurrently generated on the signal electrodes and ground electrodes, respectively. The positive electric charges on one signal electrodes are never cancelled with the negative electric charges on the ground electrodes. For this reason, the electric signal S5 is same in polarity as the electric signal S6, and both electric signals S5/S6 are supplied from the pickup unit 42 to the signal processing system 46.

Although the piezoelectric transducers 42*a*/42*b*/42*d*/42*e* are not thin and, accordingly, are small in capacitance, the piezoelectric transducers 42*a*/42*d* and the piezoelectric transducers 42*b*/42*e* are connected in parallel so that the total capacitance of each group 44*a*/44*b* is twice as large as the piezoelectric transducer 42*a*/42*d* or 42*b*/42*e*. The output impedance Z of the pickup unit 42 is expressed as $$Z=1/(2\pi f\times 2C) \qquad \text{equation 1}$$

where C is the capacitance of each piezoelectric transducer 42*a*/42*b*/42*d*/42*e* and f is the frequency. On the other hand, the output impedance Z' of the prior art pickup unit is given as $$Z'=1/(2\pi fC) \qquad \text{equation 2}$$

Comparing equation 1 with equation 2, it is understood that the output impedance Z is drastically reduced.

The reduction in output impedance is desirable, because the cutoff frequency is lowered. As a result, the pickup unit 42 can convert low-frequency vibration components to the electric signals S5/S6, and the signal-to-noise ratio is lowered.

Figure 19:
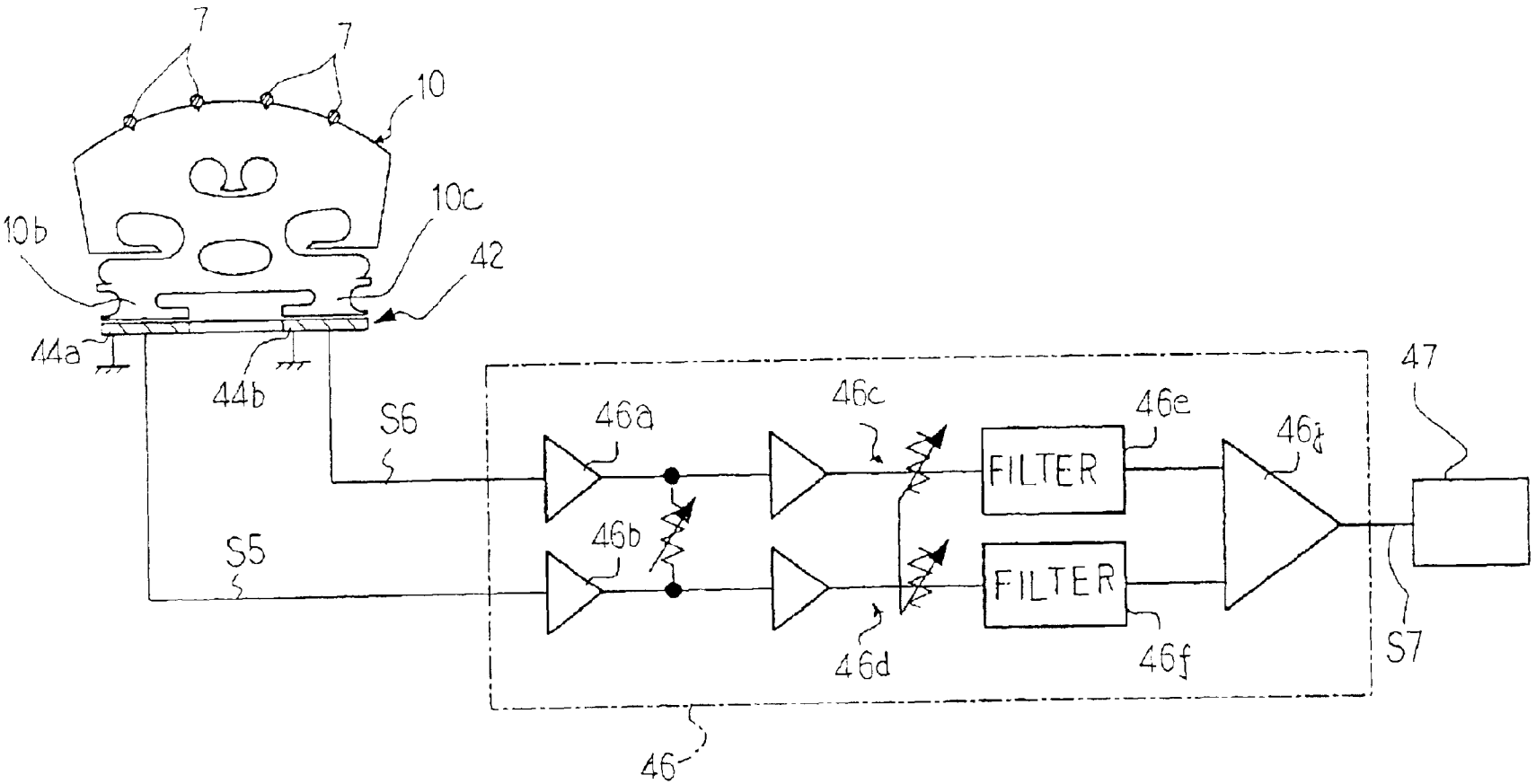
FIG. 19 is a circuit diagram showing the system configuration of a signal processing system connected to the pickup unit.

FIG. 19 shows the signal processing system 46 and a speaker system 47 connected thereto. The signal processing system 46 includes pre-amplifiers 46*a*/46*b*, power amplifiers 46*c*/46*d*, filters 46*e*/46*f* and an adder 46*j*. The signal electrodes of the piezoelectric transducers 42*a*/42*d* are connected to the pre-amplifier 46*b*, and the signal electrodes of the other piezoelectric transducers 42*d*/42*e* are connected to the other pre-amplifier 46*a*. The electric signals S5/S6 representative of the transverse vibration components are supplied to the pre-amplifiers 46*a*/46*b*, and the pre-amplifiers 46*a*/46*b* carries out the tone-control, balance-control and so forth on the electric signals S5/S6.

The pre-amplifiers 46*a*/46*b* are connected in parallel to the power amplifiers 46*c*/46*d*, and the power amplifiers 46*c*/46*d* amplify the electric signals S5/S6 at predetermined values of amplification factor. The electric signals S5/S6 are supplied from the power amplifiers 46*c*/46*d* to the filters 46*e*/46*f*.

The filter 46*e* is different in frequency characteristics from the other filter 46*f* Both of the filters 46*e*/46*f* transmit low-frequency signal components to the adder 46*j*, and attenuate high-frequency signal components from the electric signals S5/S6. However, the filter 46*e* has the pass band higher in frequency than the pass band of the other filter 46*f*. This is because of the fact that the high-frequency vibrations reach the piezoelectric transducer 46*e* more than the other piezoelectric transducer 46*f*.

In FIG. 19, the leftmost string 7 is assigned to the lowest register, and low-pitched tones are generated from the leftmost string 7. On the other hand, the right most string 7 is assigned to the highest register, and high-pitched tones are generated from the rightmost string 7. The first group 44*a* of piezoelectric transducers 42*a*/42*d* is closer to the string 7 for the lowest register than the second group 44*b* of piezoelectric transducers 42*b*/42*e*, and the low-frequency vibrations reach the first group 44*a* of piezoelectric transducers 42*a*/42*d* more than the second group 44*b* of piezoelectric transducers 42*b*/42*e*. On the other hand, the second group 44*b* of piezoelectric transducers 42*b*/42*e* is closer to the string 7 for the highest register than the first group of piezoelectric transducers 42*a*/42*d*, and the high-frequency vibrations reach the second group 44*b* of piezoelectric transducers 42*b*/42*e* more than the first group 44*a* of piezoelectric transducers 42*a*/42*d*. Accordingly, the electric signal S6 contains the high-frequency signal components more than those in the electric signal S5. In order to transmit the high-frequency signal components, the frequency characteristics of the filter 46*e* has the pass band higher in frequency than the pass band of the other filter 46*f*. Thus, the filters 46*e*/46*f* are independently adjusted to the most preferable frequency characteristics.

The filters 46*e*/46*f* supply the electric signals to the adder 46*j*. The adder 46*j* adds the amplitude of the signal S5 to the amplitude of the signal S6, and produces an analog tone signal S7. The analog tone signal S7 is supplied from the adder 46*j* to the speaker system 47 for generating electric tones. A headphone is incorporated in the speaker system 47, and the player may hear the electric tones through the headphone without disturbance to the neighborhood.

Assuming now that a player is bowing the strings 7, the vibrations are transmitted from the vibrating strings 7 to the bridge 10. The vibrations are propagated through the leg portions to the pair of piezoelectric transducers 22*a*/22*b*, and are further propagated through the insulating layer 22*c* to the pair of piezoelectric transducers 22*d*/22*e*. Although the vibrations contain both of the transverse vibration components and the vertical vibration components, the transverse vibration components are converted to the electric signal S1 through the pair of piezoelectric transducers 22*a*/22*b*, and the vertical vibration components are converted to the electric signal S2 by means of the other pair of piezoelectric transducers 22*d*/22*e*. The electric signals S1 and S2 are supplied in parallel through the pre-amplifiers 23*a*/23*b* to the filters 23*c*/23*d*.

The filter 23*c* eliminates the high-frequency signal components from the electric signal S1, and supplies the electric signal S1, which is representative of the low-frequency transverse vibration components equivalent to the fundamental tone and low-order harmonic, through the power amplifier 23*e* to the adder 23*h*. On the other hand, the filter 23*d* eliminates the low-frequency signal components from the electric signal S2, and supplies the electric signal S2, which is representative of the high-frequency vertical vibration components equivalent to the high-order harmonics, through the power amplifier 23*f* to the adder 23*h*.

The adder 23*h* combines the electric signal into the analog tone signal S3. The analog tone signal S3 contains the low-frequency signal components representative of the fundamental tone and low-order harmonic and the high-frequency signal components representative of the high-order harmonics. The adder 23*h* supplies the analog tone signal S3 to the speaker system 24, and the electric tones, which contain the high-order harmonics as well as the fundamental tones and low-order harmonic, are radiated from the speaker system 24.

As will be understood from the foregoing description, plural piezoelectric transducers 42*a*/42*d* and 42*d*/42*e* are connected in parallel for forming two piezoelectric transducer groups 44*a*/44*b*, and the piezoelectric transducers 42*a*/42*e* on one diagonal line are polarized oppositely to the piezoelectric transducers 42*b*/42*d* on the other diagonal line. This results in that the two piezoelectric transducer groups 44*a*/44*b* convert the transverse vibration components of the bridge 10 to the electric signals without cancellation between the electric signals. The plural piezoelectric transducers 42*a*/42*d* and 42*b*/42*e* increase the total capacitance of the piezoelectric transducer groups 44*a*/44*b*, and make the output impedance of the pickup unit 42 decreased. As a result, the cutoff frequency is lowered, and, accordingly, the low-frequency vibration components representative of the fundamental tones are surely converted to the electric signals. The standard piezoelectric transducers 42*a*/42*b*/42*d*/42*e* are not so expensive that the production cost for the electric guitar 41 is reduced. Thus, the pickup unit 42 implementing the second embodiment is effective against the second problem.

Moreover, the stacked structure of the piezoelectric transducers 42*a*/42*b*/42*d*/42*e* is preferable. If plural piezoelectric transducers are separately embedded in the bridge, the piezoelectric transducers are connectable in parallel for forming plural piezoelectric transducer groups. Although the parallel combinations increase the total capacitance of the group, the magnitude of vibrations is not constant among the embedded portions, and the electric signals do not exactly express the vibrations of the bridge. On the other hand, the vibrations reach the piezoelectric transducers of each group without difference in magnitude, because the piezoelectric transducers 42*a*/42*d* and 42*b*/42*e* are stacked. This results in the electric signals S5/S6 exactly expressing the transverse vibration components.

Another advantage of the stacked structure of the pickup unit 42 is the large amount of electric charges generated in each piezoelectric transducer. If plural piezoelectric transducers are adhered in parallel to each of the reverse surfaces of the leg portions 10*b*/10*c*, it is possible to connect plural piezoelectric transducers in parallel between the ground and the signal processing system 46. However, such a planar arrangement requires small piezoelectric transducers. The small piezoelectric transducers generate only a small amount of electric charges, and the electric signals vary in a narrow potential range. On the other hand, the piezoelectric transducers 42*a*/42*d* or 42/42*e* of the stacked structure occupy the entire reverse surface of each leg portion 10*b*/10*c*. This results in that each piezoelectric transducer generates a large amount of electric charges, and the electric signals S5/S6 vary in a wide potential range.

Modifications of Second Embodiment

Figure 20:
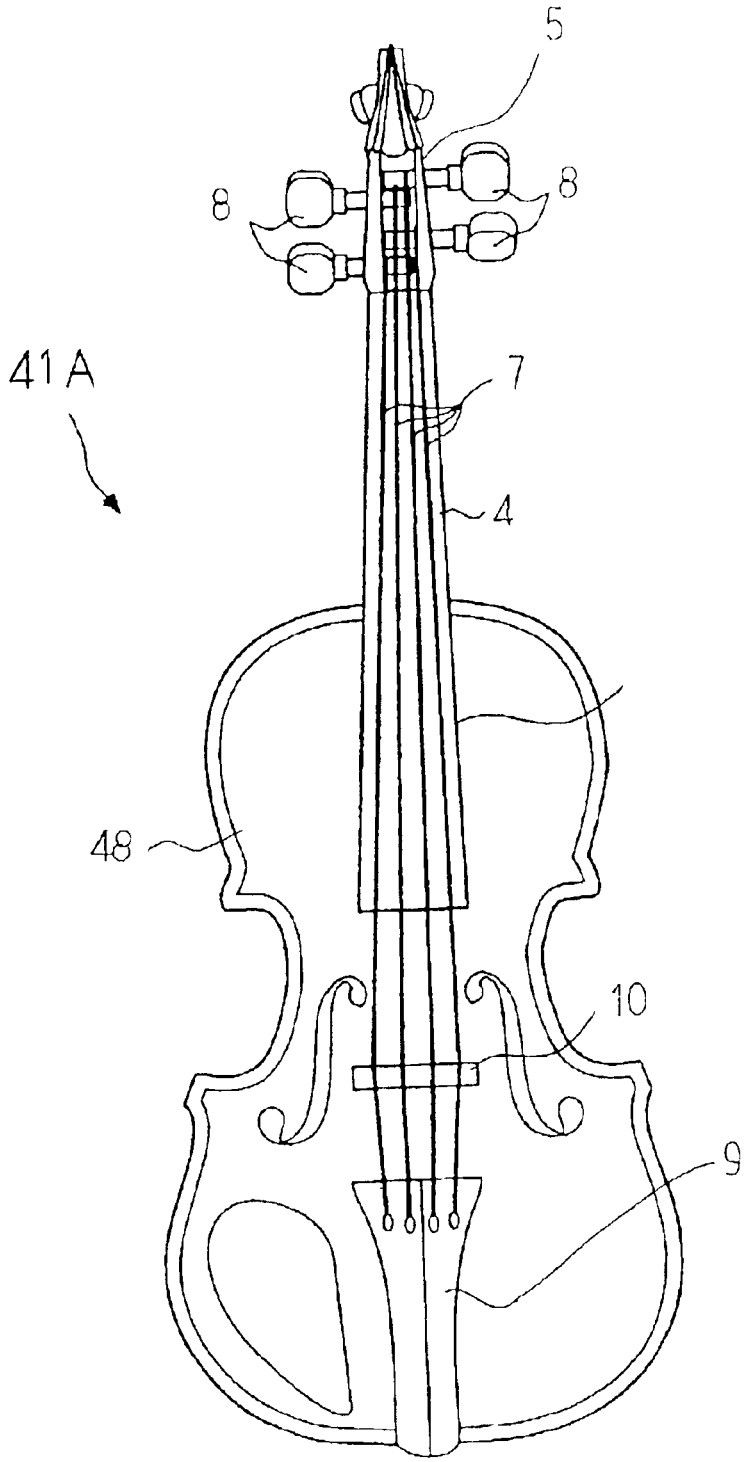
FIG. 20 is a plan view showing the first modification of the electric violin.

FIG. 20 shows a modification 41A of the electric violin 41. The modification 41A is of the electric acoustic violin. The trunk 2, frame body 3 and chin rest 6 are replaced with a body 48 with a resonator, which is corresponding to the body of an acoustic violin. Other component parts of the electric acoustic violin 41A are labeled with the same references designating corresponding component parts of the electric violin 41 for the sake of simplicity.

In the second embodiment, frame body 3, fingerboard 4, peg box 5, chin rest 6, tailpiece 9 and bridge 10 as a whole constitute a vibratory body. In the electric acoustic violin 41A, the body 35, peg box 5, tailpiece 9 and bridge 10 as a whole constitute a vibratory body. The piezoelectric transducers 42*a*/42*b*/42*d*/42*e* serve as vibration-to-electric signal converters.

Third Embodiment

Figure 21:
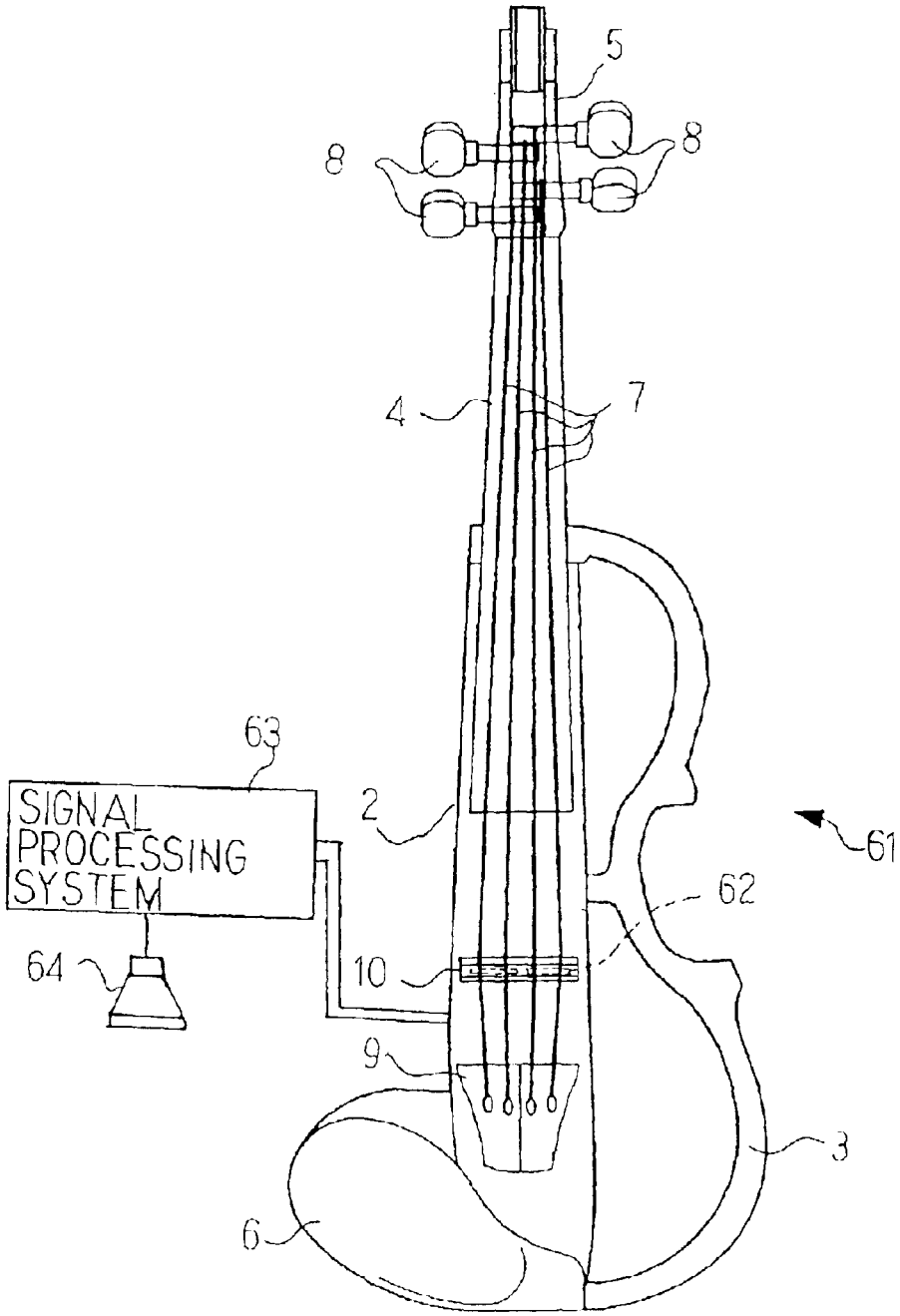
FIG. 21 is a plan view showing the structure of yet another electric violin according to the present invention.

FIG. 21 shows yet another electric violin 61 embodying the present invention. The electric violin 61 largely comprises a trunk, a frame body, a fingerboard, a peg box, a chin rest, strings, pegs, a tailpiece, a bridge and a pickup unit 62, and a signal processing system 63 is connected to the pickup unit 62. A speaker system 64 is connected to the signal processing system 63, and electric tones are radiated from the speaker system 64. Though not shown in FIG. 21, a headphone is incorporated in the speaker system, and a player can hear the electric tones through the headphone without disturbance to the neighborhood. The signal processing system 63 is built in the trunk 2. However, the signal processing system 63 may be separated from the electric violin 61.

Figure 1:
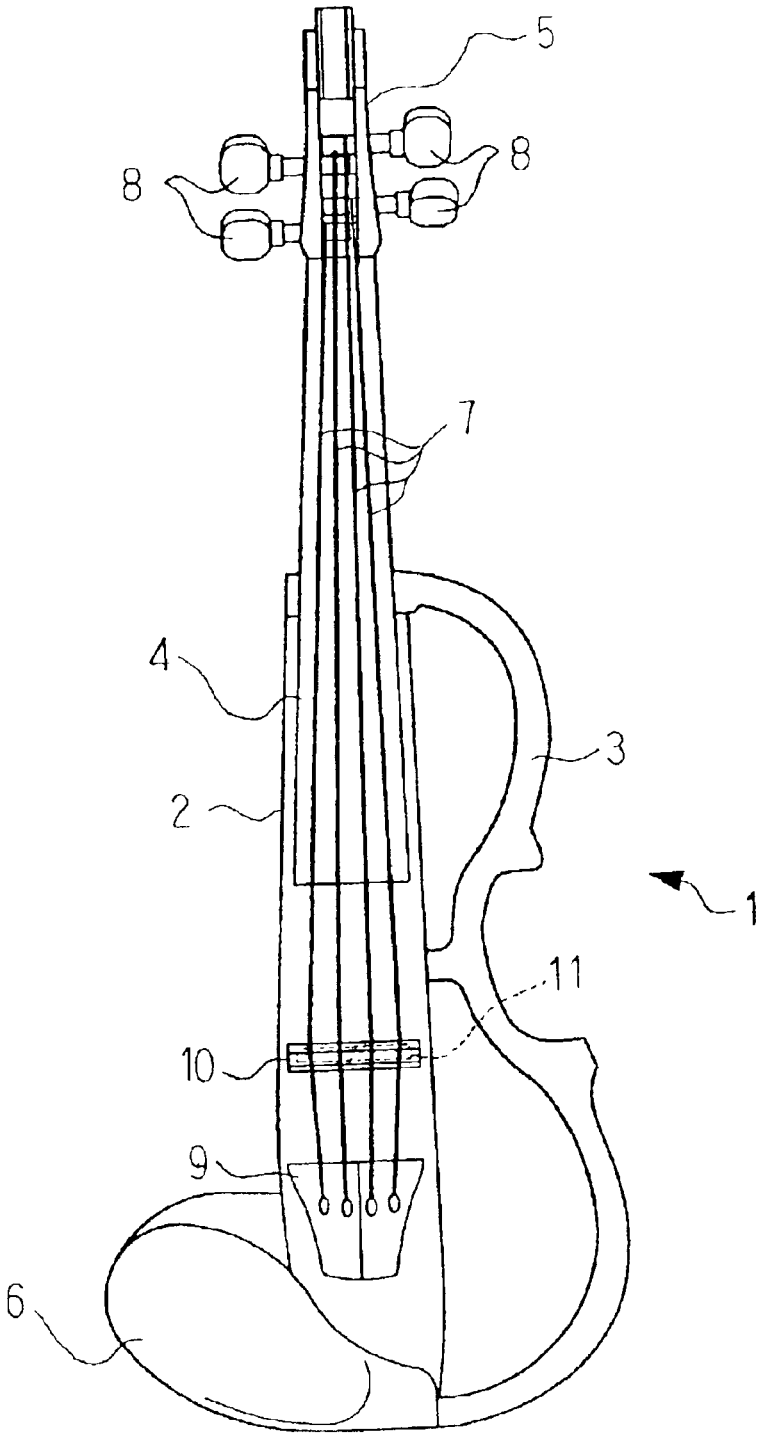
Fig. 1 PRIOR ART
FIG. 1 is a plan view showing the prior art electric violin.
Figure 2:
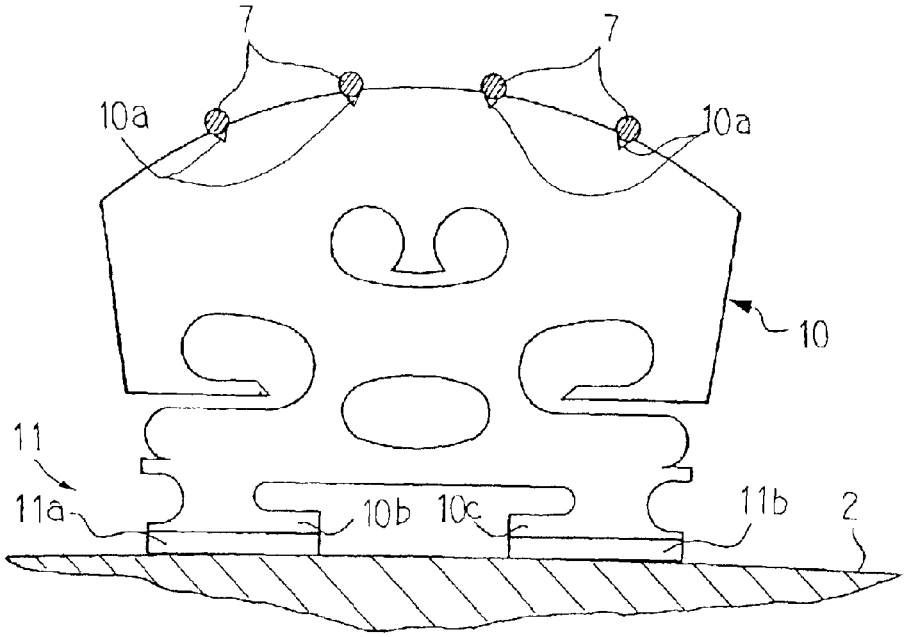
Fig. 2 PRIOR ART
FIG. 2 is a front view showing the bridge and pickup unit incorporated in the prior art electric violin.
Figure 3:
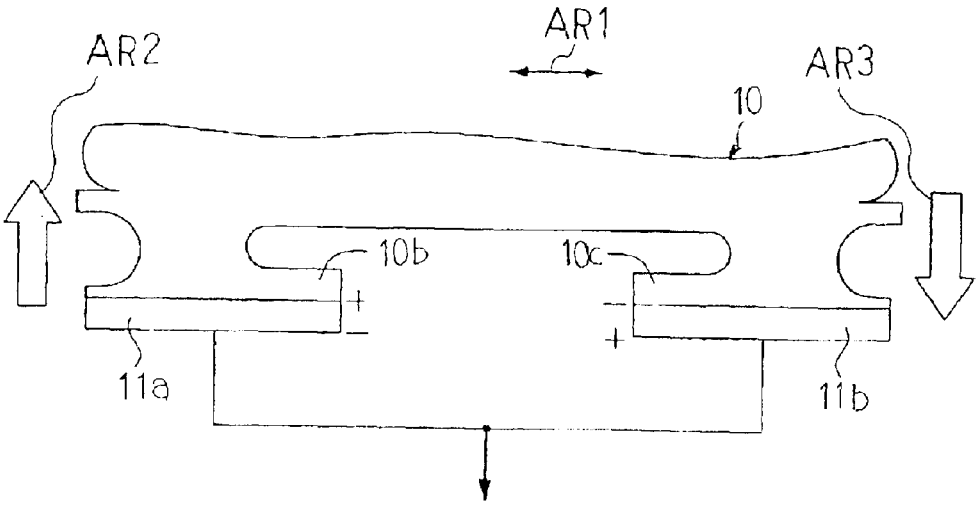
Fig. 3 PRIOR ART
FIG. 3 is a front view showing the bridge exerting the transverse vibration components on the piezoelectric transducers.
Figure 4:
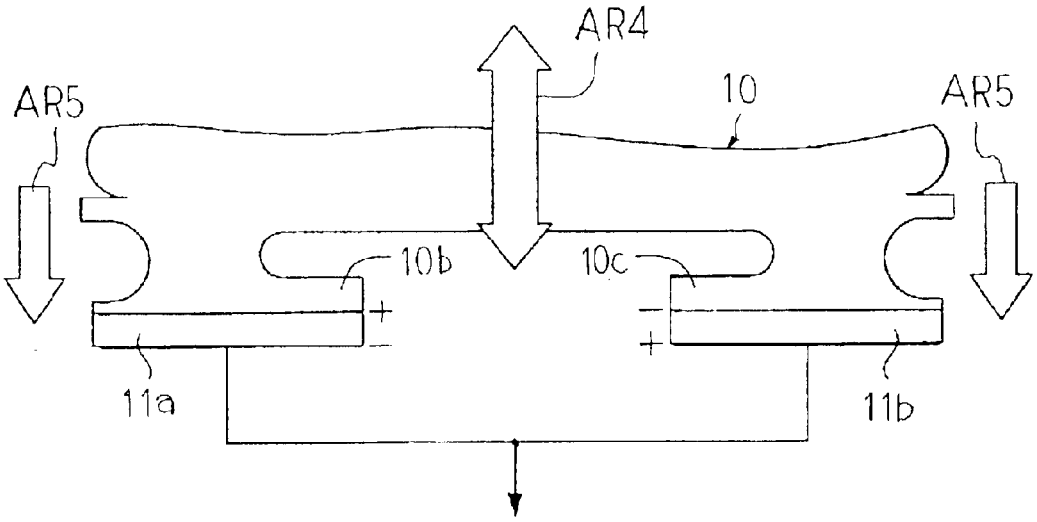
Fig. 4 PRIOR ART
FIG. 4 is a front view showing the bridge exerting the vertical vibration components on the piezoelectric transducers.
Figure 22:
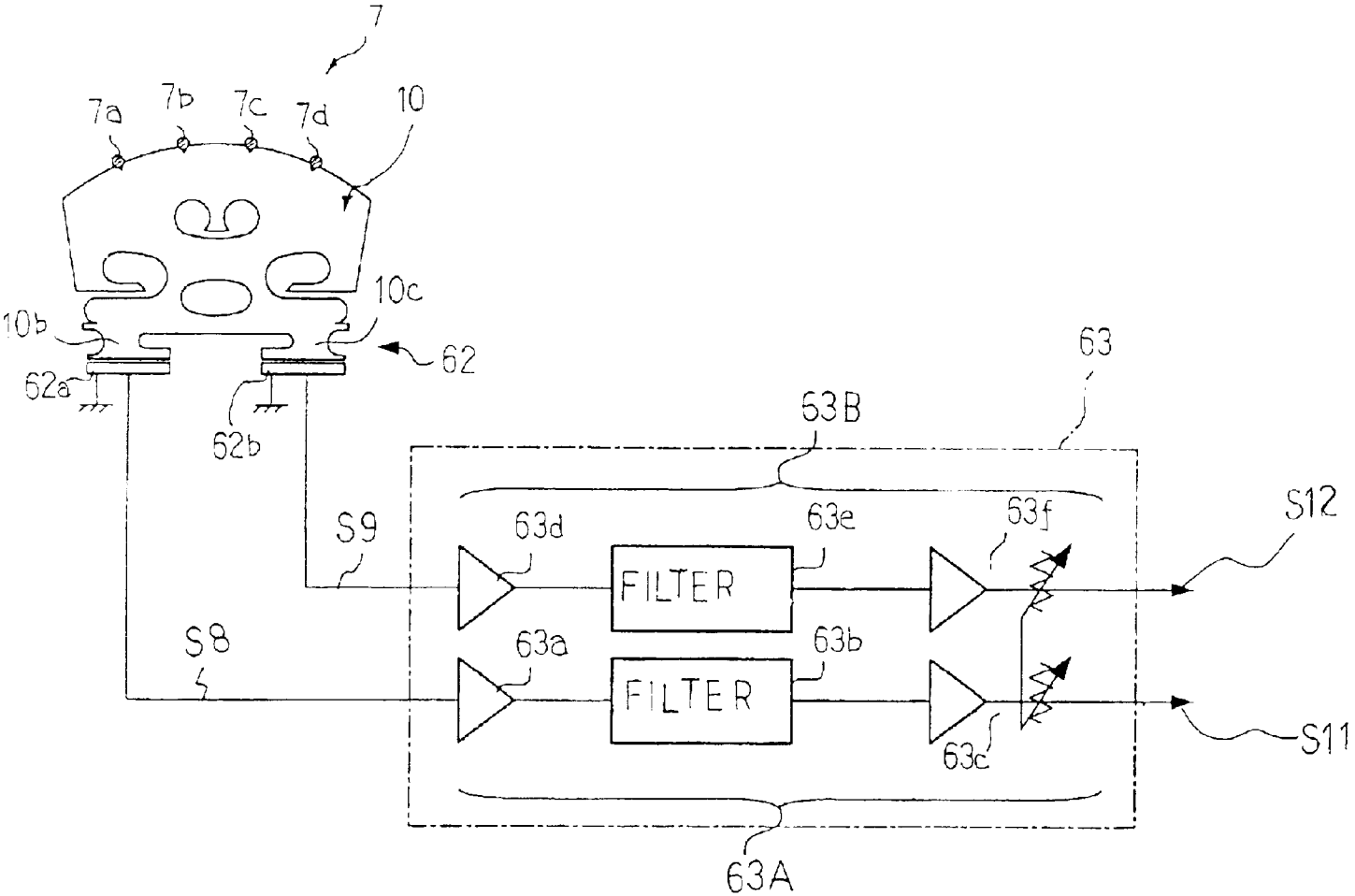
FIG. 22 is a circuit diagram showing the system configuration of a signal processing system connected to the electric violin according to the present invention.
Figure 23A:
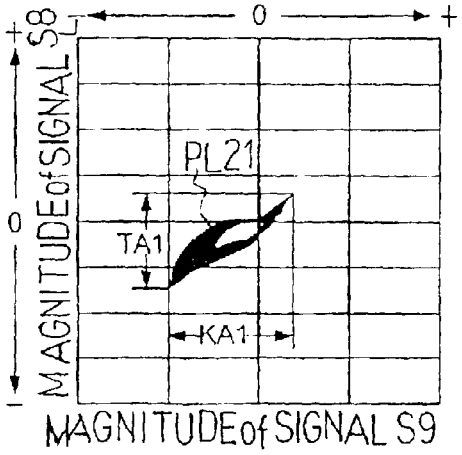
FIGS. 23A to 23D are graphs showing the balance between electric signals in the bowing on four strings.
Figure 23B:
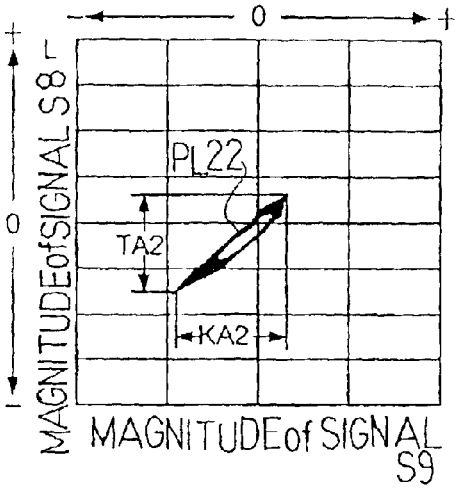
Figure 23C:
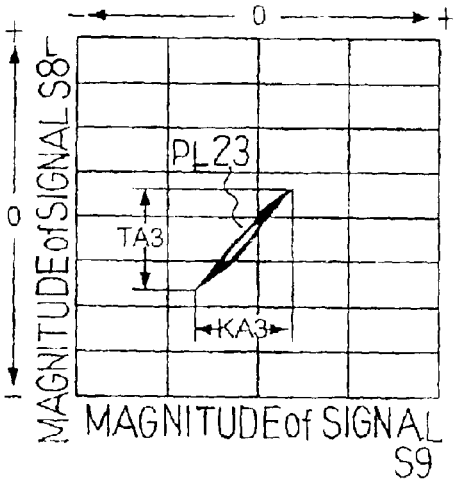
Figure 23D:
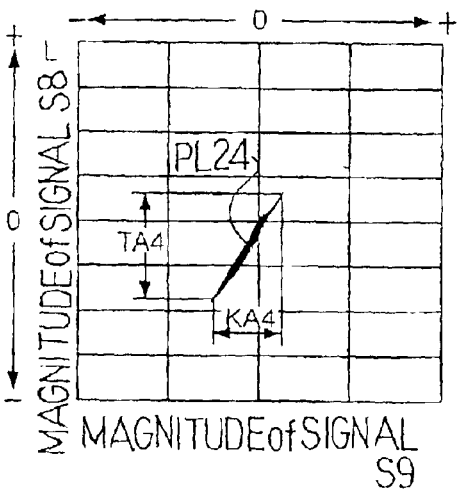

The trunk, frame body, fingerboard, peg box, chin rest, strings, pegs, tailpiece and bridge are similar to those of the prior art bowed stringed musical instrument shown in FIG. 1, and are labeled with the references designating the corresponding component parts without detailed description. The string 7 for the lowest register is closest to the chin rest 6, i.e., leftmost, and is used for low-pitched tones. The register assigned to the strings is lowered from the rightmost string toward the leftmost string. Thus, the arrangement of strings 7 is identical with that of acoustic violins. The strings are labeled with 7*a*, 7*b*, 7*c* and 7*d* from the left side to the right side as shown in FIG. 22. Although the pickup unit 62 is same as the prior art pickup unit, the pickup unit 22 or 42 is available for the electric violin 61.

The bridge 10 has two leg portions 10*b*/10*c*, and the string 7*a* for the lowest register and the string 7*d* for the highest register are over the leg portions 10*b* and 10*c*, respectively. The pickup unit 62 includes piezoelectric transducers 62*a* and 62*b*. The piezoelectric transducer 62*a* is provided between the upper surface of the trunk 2 and the leg portion 10*b*, and converts vibrations of the leg portion 10*b* to an electric signal S8. The string 7*a* for the lowest register is the closest to the piezoelectric transducer 62*a* so that the string 7*a* is the most influential on the piezoelectric transducer 62*a*. On the other hand, the other piezoelectric transducer 62*b* is provided between the upper surface of the trunk 2 and the other leg portion 10*c*, and converts vibrations of the leg portion 10*c* to another electric signal S9. The string 7*d* for the highest register is the closest to the piezoelectric transducer 62*b* so that the string 7*d* is the most influential on the piezoelectric transducer 62*b*.

FIG. 17 shows the signal processing system 63. The signal processing system 63 separately produces two-channel tone signals S11 and S12 from the electric signals S8/S9. The signal processing system 63 has two signal processing lines 63A and 63B. The signal processing line 63A is assigned to the electric signal S8, and produces the left-channel tone signal S11 from the electric signal S8. On the other hand, the signal processing line 63B is assigned to the electric signal S9, and produces the right-channel tone signal S12 from the electric signal S9.

The signal processing line 63A includes a pre-amplifier 63*a*, a filter 63*b* and a volume controller 63*c*. Similarly, the signal processing line 63B includes a pre-amplifier 63*d*, a filter 63*e* and a volume controller 63*f*. The electric signals S8/S9 are supplied from the piezoelectric transducers 62*a*/62*b* through the pre-amplifiers 63*a*/63*d* to the filters 63*b*/63*e*, respectively.

The filters 63*b* and 63*e* are different in frequency characteristics from one another. The filter 63*b* transmits signal components in a given pass band to the volume controller 63*c*, and attenuates the signal components in the attenuation band. Similarly, the filter 63*e* transmits signal components in another given band to the volume controller 63*f*, and attenuates the other signal components. Thus, the filters 63*b* and 63*e* supply the certain signal components of the electric signals S8/S9 to the volume controllers 63*c*/63*f*, and the volume controllers 63*c*/63*f* amplify the signal components of the electric signals S8/S9 at values of amplification factor specified by a user. Thus, the left-channel tone signal S11 and right-channel tone signal S12 are separately produced from the electric signals S8/S9, and are supplied to the speaker system 64. The electric tones separately produced from the electric signals S8/S9 notice the player of change of bowed string or strings.

The present inventor measured the magnitude or voltage level of the electric signals S8 and S9, and plotted in FIGS. 23A to 23D. FIGS. 23A to 23D are Lissajous figures, and the scale in FIGS. 23A to 23D are identical with one another.

While the inventor was bowing the rightmost string 7*d*, the electric signals S8 and S9 were varied as indicated by plots PL21. TA1 was indicative of the peak-to-peak value, i.e., the difference between the maximum value and the minimum value of the signal S8, and KA1 was indicative of the peak-to-peak value of the electric signal S9. Comparing KA1 with TA1, the string 7*d* for the highest register caused the leg portion 10*c* to widely vibrate, and the amplitude of the electric signal S9 was larger than that of the electric signal S8.

While the inventor was bowing the string 7*c*, the electric signals S8 and S9 varied the amplitude as indicated by plots PL22. TA2 was indicative of the amplitude of the signal S8, and KA2 was indicative of the amplitude of the electric signal S9. Comparing KA2 with TA2, it was understood that the amplitude of the electric signal S9 was slightly larger than that of the electric signal S8.

While the inventor was bowing the string 7*b*, the electric signals S8 and S9 varied the amplitude as indicated by plots PL23. TA3 was indicative of the amplitude of the signal S8, and KA3 was indicative of the amplitude of the electric signal S9. Comparing KA3 with TA3, it was understood that the amplitude of the electric signal S9 was slightly smaller than that of the electric signal S8.

While the inventor was bowing the string 7*a*, the electric signals S8 and S9 varied the amplitude as indicated by plots PL24. TA4 was indicative of the amplitude of the signal S8, and KA4 was indicative of the amplitude of the electric signal S9. Comparing KA4 with TA4, it was understood that the amplitude of the electric signal S9 was smaller than that of the electric signal S8.

Figure 24:
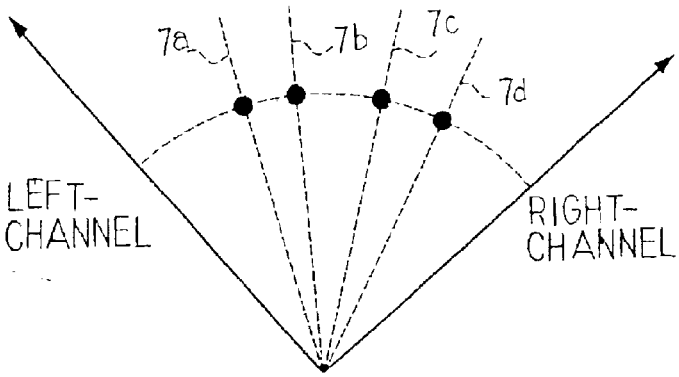
FIG. 24 is a graph showing the influence of the strings on the electric signals.

The influence of the strings 7*a* to 7*d* on the right-channel/left-channel is illustrated in FIG. 24. The influence on the electric signal S8, i.e., the left-channel was decreased from the string 7*a* through the strings 7*b* and 7*c* to the string 7*d*. On the other hand, the influence on the electric signal S9 was decreased from the string 7*d* through the strings 7*c* and 7*b* to-the string 7*a*. The present inventor calculated the signal magnitude ratio SH as follows.

$$SH=-20\log\{(\text{magnitude of electric signal } S8)/(\text{magnitude of electric signal } S9)\} \quad \text{equation 3}$$

Figure 25:
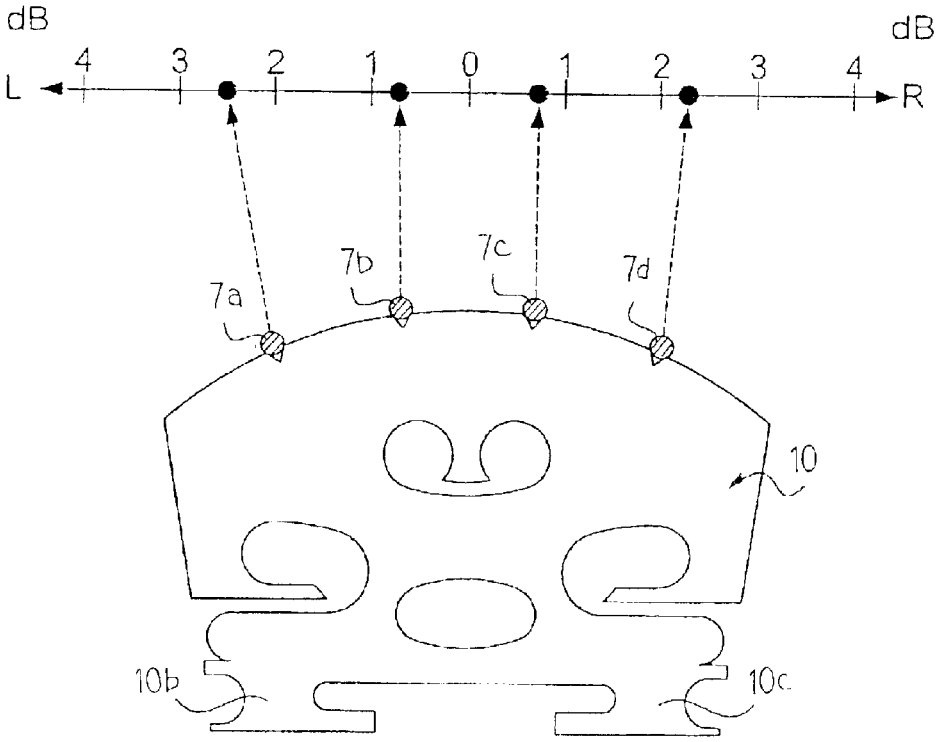
FIG. 25 is a graph showing a signal magnitude ratio of the four strings.

The present inventor plotted the signal magnitude ration SH as shown in FIG. 25. The reason why the strings 7*a* to 7*d* had the different influence on the electric signals S8 and S9 was that the vibrations were decayed in inversely proportional to the distance between the strings 7*a* to 7*d* and the piezoelectric transducers 62*a*/62*b*. The piezoelectric transducer 62*a* was provided under the leg portion 10*b*, and the vibrations were propagated from the strings 7*a*–7*d* through the leg portion 10*b* to the piezoelectric transducer 62*a*. The longer the distance, the larger the decay. The string 7*a* was the nearest to the piezoelectric transducer 62*a*, and the string 7*d* was the farthest from the piezoelectric transducer 62*a*. Although the vibrations of the string 7*a* were slightly decayed until reaching the piezoelectric transducer 62*a*, the vibrations of the string 7*d* were seriously decayed. Similarly, The piezoelectric transducer 62*b* was provided under the leg portion 10*c*, and the vibrations were propagated from the strings 7*a*–7*d* through the leg portion 10*c* to the piezoelectric transducer 62*b*. The string 7*d* was the nearest to the piezoelectric transducer 62*b*, and the string 7*a* was the farthest from the piezoelectric transducer 62*b*. Although the vibrations of the string 7*d* were slightly decayed until reaching the piezoelectric transducer 62*b*, the vibrations of the string 7*a* were seriously decayed.

Thus, the present inventor found that the signal magnitude ratio SH represented the position of the strings 7*a* to 7*d*. Although FIGS. 24 and 25 illustrated the tendency observed in one electric violin, other electric violins exhibited the same tendency in so far as the bridges were those usually employed in the violins. The material and shape of the bridges did not have any serious influence on the tendency.

When a player changes the bowed string from one to another, the frequency spectrum, which represents the fundamental tone and its harmonics, is varied. However, the signal magnitude ratio SH is processed easier than the frequency spectrum. The signal magnitude ratio is available for the expression of movement of a sound image. Although the player stands extremely close to the vibrating strings, it is possible to express the position of bowed string through the left-channel/right-channel tone signals, which are separately produced from the electric signals S8 and S9.

Figure 26:
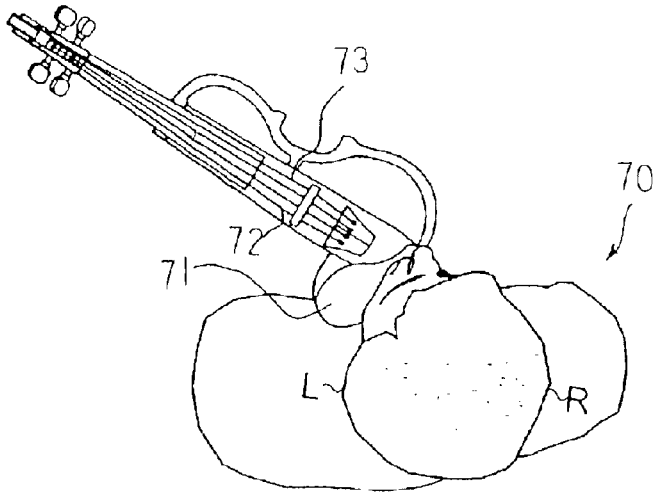
FIG. 26 is a top view showing a violinist bowing strings of a violin.

While a player 70 is playing a piece of music on an acoustic violin, the player puts his or her chin on the chin rest 71. (See FIG. 26) This means that the string 72 for the lowest register is closer to the left ear L than the string 73 for the highest register and that the string 73 for the highest register is closer to the right ear R than the string 72 for the lowest register. The player hears higher-pitched tones at the right ear R larger than lower-pitched tones, and hears the lower-pitched tones at the left ear L larger than the higher-pitched tones. As described hereinbefore, the piezoelectric transducer 62*a* is strongly responsive to the string 4*a* for generating the electric signal S8, and the other piezoelectric transducer 62*b* is strongly responsive to the string 4*d* for generating the electric signal S9. This phenomenon is expressed by the signal magnitude ratio SH. Thus, the impression of the electric tones to the left and right ears L/R is analogous to the signal magnitude ratio between the electric signals S8 and S9.

The present inventor thought it possible to express the change of bowed strings through the left-channel/right-channel signals S11/S12 separately on the basis of the electric signals S8/S9. For this reason, the signal processing system 63 has two signal processing lines 63A/63B (see FIG. 22), and the left-channel/right-channel signals S11/S12 are produced from the electric signals S8/S9 separately through the signal processing lines 63A/63B. As a result, the player discriminates the bowed string from the previous bowed string.

Although the impression of the electric tones to the left/right ears L/R is analogous to the signal magnitude ratio SH, differences in material and shape among the bridges are not ignoreable. When a user changes the bridge 10 from one to another, it is not rare that the vibration propagating characteristics are changed. The difference in vibration propagating characteristics is taken up by changing the frequency characteristics of the filters 63*b*/63*e*.

Figure 27:
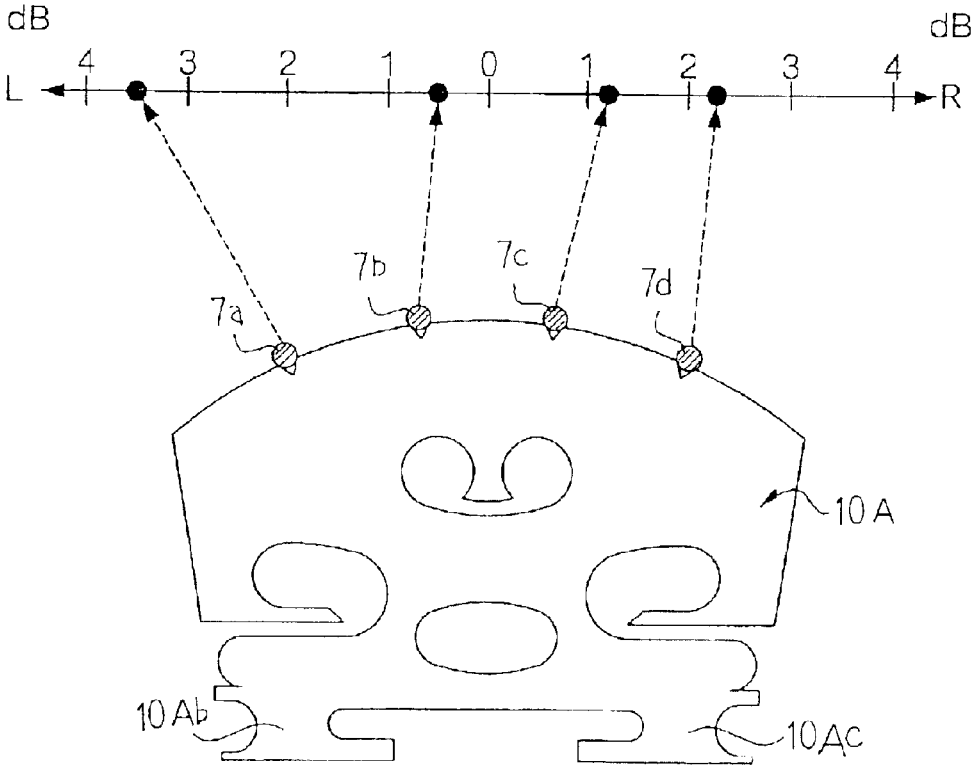
FIG. 27 is a graph showing the influence of the strings on the signal magnitude ratio under the condition that the bridge is replaced with another one.

Assuming now that the bridge 10 is changed to a new bridge 10A, the signal magnitude ratio SH is changed from the values shown in FIG. 25 to other values shown in FIG. 27. The signal magnitude ratio SH of the string 7*a* is leftward moved, and the influence on the piezoelectric transducer 62*a* is increased. In order to correct the unbalance, the filters 63*b* and 63*e* are replaced with filters having different frequency characteristics. The filter with which the filter 63*b* is replaced transmits high-frequency signal components more than those transmitted by the filter 63*b*, and attenuates low-frequency signal components more than those attenuated by the filter 63*b*. On the other hand, the filter with which the filter 63*e* is replaced transmits low-frequency signal components more than those transmitted by the filter 63*e*, and attenuates high-frequency signal components more than those attenuated by the filter 63*e*. This results in that the signal magnitude ratio SH returns to the value approximately equal to that of the bridge 10.

As will be understood from the foregoing description, the electric violin 61 is effective against the third problem. The signal processing system 63 has plural signal processing lines 63A/63B, and the plural signals S8/S9 are separately processed through the signal processing system 63A/63B. The plural vibration detectors 62*a*/62*b* convert the vibrations propagated through the bridge 10 to the electric signals S8/S9, and the amounts of frequency components of each electric signal S8/S9 are inversely proportional to the distance between the strings 7*a* to 7*d* and the associated vibration detector 62*a*/62*b*. The signal processing lines 63A/63B regulate the signal magnitude ratio between the electric signals S8/S9 to the impression of the electric tones to the left/right ears. For this reason, the electric tones notify the player and audience of the change of bowed string or strings.

Modification of Third Embodiment

Figure 28:
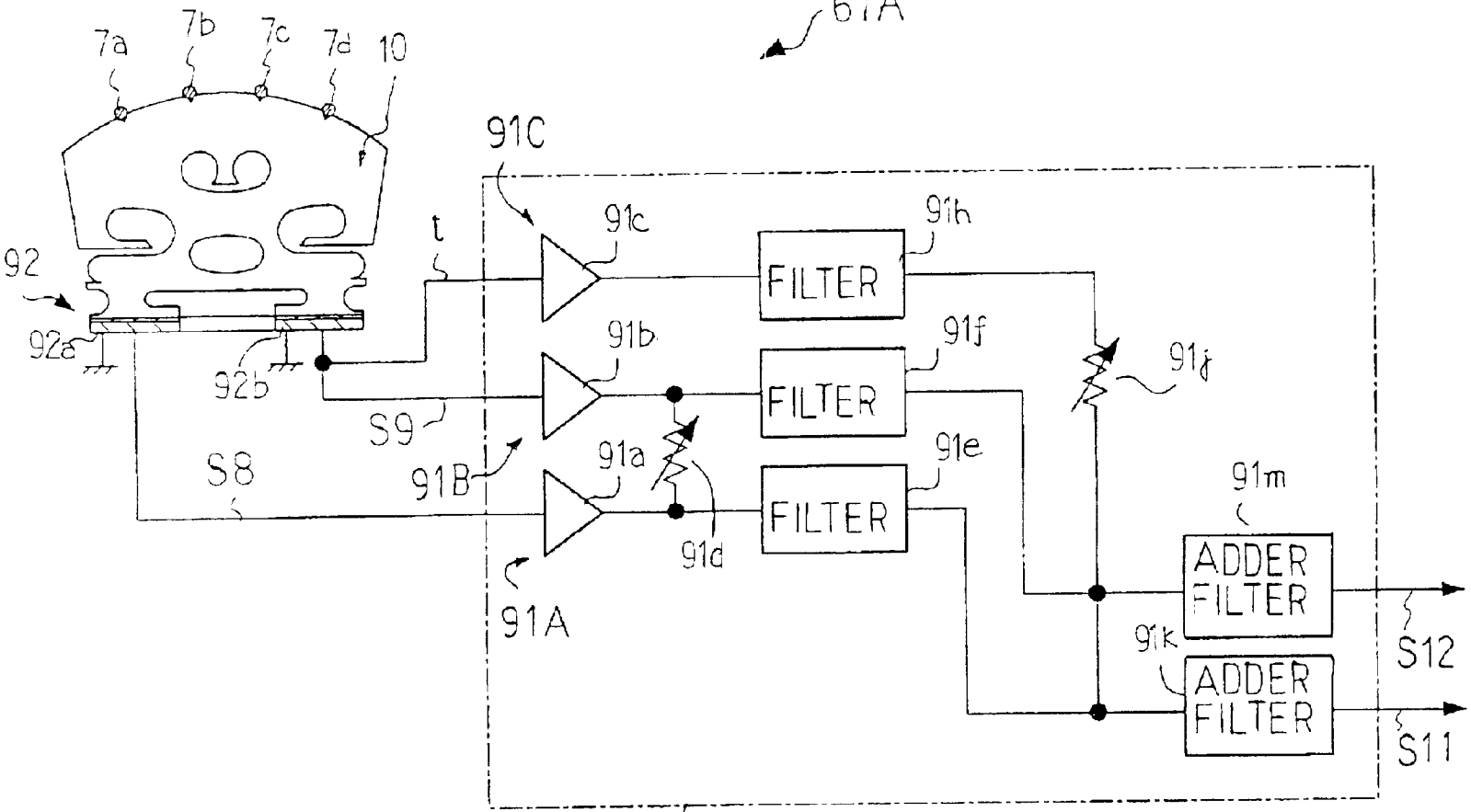
FIG. 28 is a circuit diagram showing a signal processing system incorporated in the first modification of the electric violin.
Figure 29:
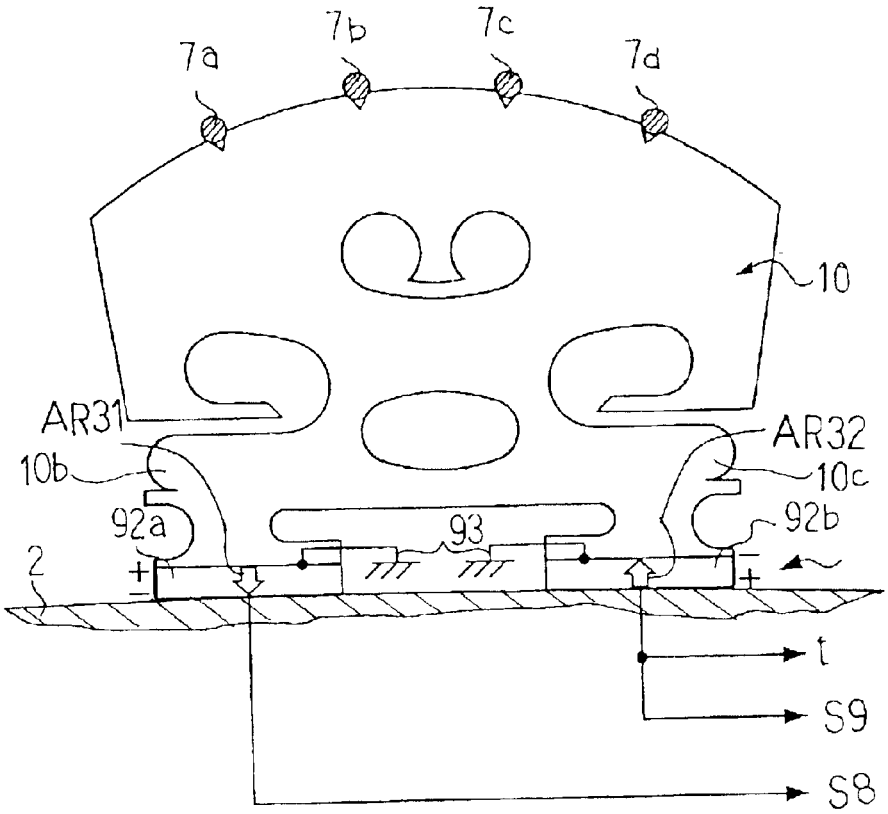
FIG. 29 is a front view showing a pickup unit incorporated in the first modification.

FIG. 28 shows the first modification 61A of the electric violin 61. The electric violin 61A includes a signal processing system 91 and a pickup unit 92. The pickup unit 92 has piezoelectric transducers 92*a* and 92*b*, and the piezoelectric transducers 92*a* and 92*b* are oppositely polarized as indicated by arrows AR31/AR32 (see FIG. 29). Ground electrodes are formed on the upper surfaces of the piezoelectric transducers 92*a*/92*b*, and are connected to the ground 93. Signal electrodes are formed on the lower surfaces of the piezoelectric transducers 92*a*/92*b*, and are connected to the signal processing system 91.

The oppositely polarized piezoelectric transducers 92*a*/92*b* converts the transverse vibration components to the electric signals S8/S9, and the piezoelectric transducer 92*b* converts the vertical vibration components to the electric signal t. The signal processing system 91 is broken down into three signal processing lines 91A, 91B and 91C, and includes pre-amplifiers 91*a*/91*b*/91*c*, a volume controller 91*d*, filters 91*e*/91*f*/91*h*, a volume controller 91*j* and adders/filters 91*k*/91*m*. The piezoelectric transducer 92*a* supplies the electric signal S8 through the pre-amplifier 91*a* to the filter 91*e*, and the piezoelectric transducer 92*b* supplies the electric signals S9/t through the pre-amplifiers 91*b*/91*c* to the filters 91*f*/91*h*. The electric signal S9 is identical with the electric signal t.

Figure 30A:
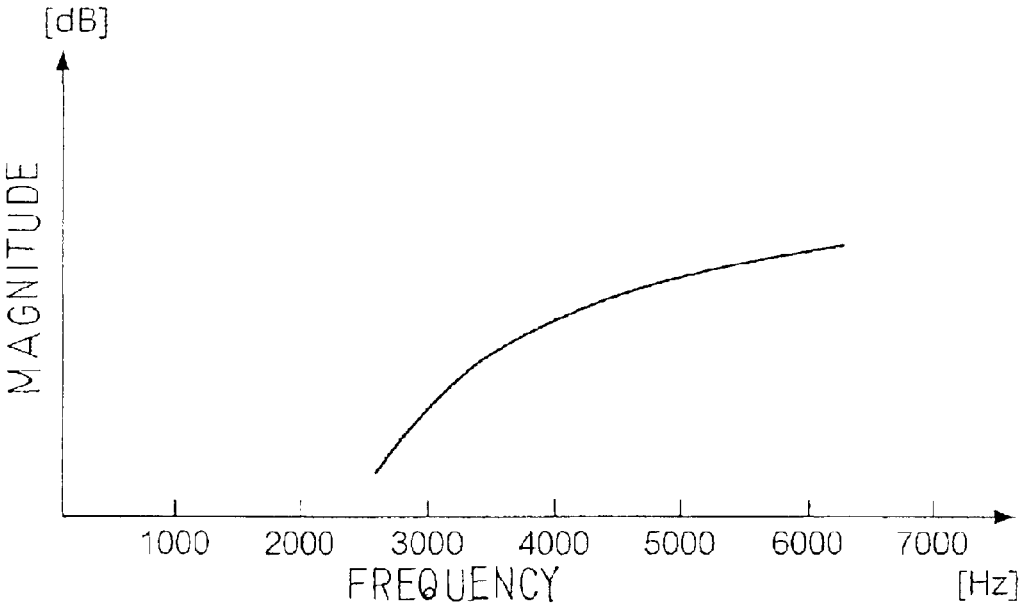
FIGS. 30A and 30B are graphs showing the frequency characteristics of filters incorporated in the signal processing system.
Figure 30B:
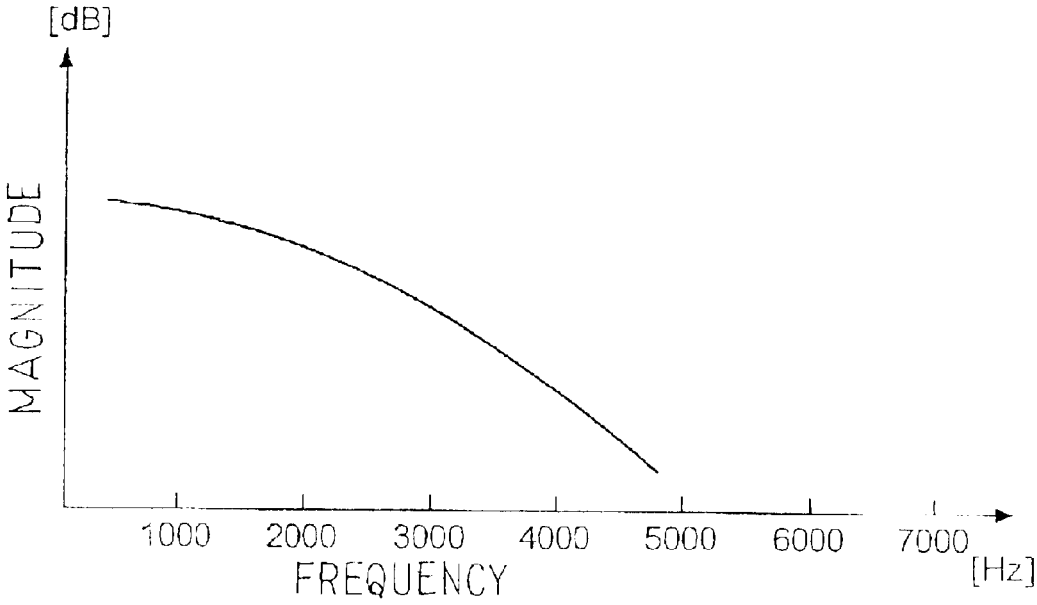

The filters 91*e*/91*f*/91*h* are different in frequency characteristics from one another. FIG. 30A shows the frequency characteristics of the filter 91*h*, and FIG. 30B shows the frequency characteristics of the filters 91*e*/91*f*. The filter 91*h* transmits high-frequency signal components representative of the higher-order harmonics equal to or higher than fourth order, and attenuates the low-frequency signal components representative of the fundamental tone and low-order harmonics. On the other hand, the filters 91*e*/91*f* transmit the low-frequency signal components representative of the fundamental tone and low-order harmonics, and attenuate the high-frequency signal components representative of the high-order harmonics. This is because of the fact that the transverse vibration components and vertical vibration components include low-frequency vibration components representative of the fundamental tone and low-order harmonics and high-frequency vibration components representative of the high-order harmonics.

The low-frequency signal components of the electric signals S8/S9 are adjusted to a magnitude instructed by the user by means of the volume controller 91*d*. On the other hand, the high-frequency signal components of the electric signal t are amplified through the volume controller 91*j* at an amplification factor given by the user. Although the electric signal t is produced by only one piezoelectric transducer 92*b*, the high-frequency signal components have a certain magnitude equal to the magnitude of the low-frequency signal components through the amplifications at the volume controllers 91*d*/91*j*.

The filters 91*e* and 91*h* supply the low-frequency signal components and high-frequency signal components to the adder/filter 91*k*, and the filters 91*f* and 91*h* supply the low-frequency signal components and high-frequency signal components to the adder/filter 91*m*. The adder/filter 91*k* adds the low-frequency signal components to the high-frequency signal components, and adjusts the signal magnitude ratio SH to the target values in the left part of the scale shown in FIG. 25. The adder/filter 91*m* adds the low-frequency signal components to the high-frequency signal components, and adjusts the signal magnitude ratio SH to the target values in the right part of the scale. Thus, the adders/filters 91*k*/91*m* produce the left-channel tone signal S11 and the right-channel tone signal S12, and supplies them to the speaker system. Although the high-frequency signal components are added to the low-frequency signal components, the electric tones notify the player of the change of bowed strings, because the high-frequency signal components merely have influences on the timbre of the electric tones.

Figure 31:
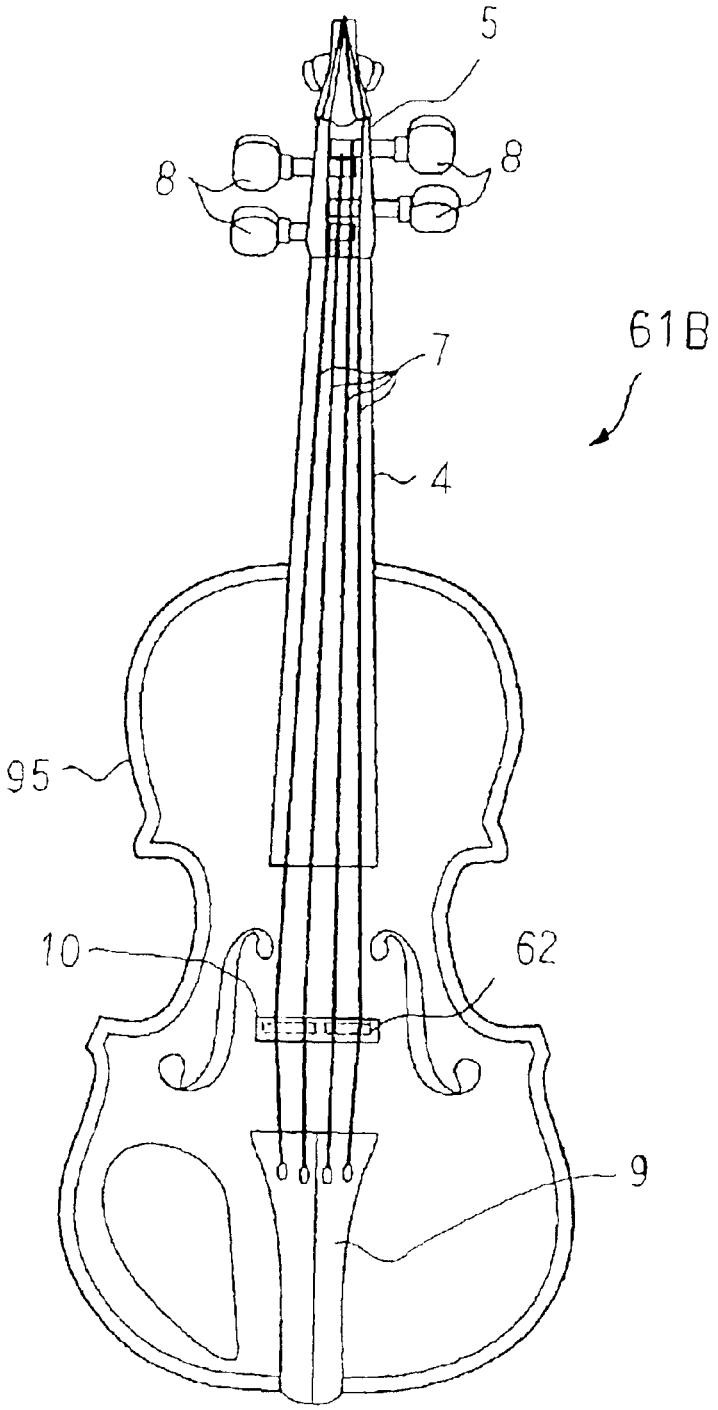
FIG. 31 is a plan view showing the second modification of the electric violin.

FIG. 31 shows the second modification 61B of the electric violin 61. The second modification 41B is of the electric acoustic violin. The trunk 2, frame body 3 and chin rest 6 are replaced with a body 95 with a resonator, which is corresponding to the body of an acoustic violin. Other component parts of the electric acoustic violin 41A are labeled with the same references designating corresponding component parts of the electric violin 41 for the sake of simplicity.

In the third embodiment and the first modification, frame body 3, fingerboard 4, peg box 5, chin rest 6, tailpiece 9 and bridge 10 as a whole constitute a vibratory body. In the electric acoustic violin 61B, the body 95, peg box 5, tailpiece 9 and bridge 10 as a whole constitute a vibratory body. The piezoelectric transducers 62*a*/62*b* and 92*a*/92*b* serve as vibration-to-electric signal converters.

Although particular embodiments of the present invention have been shown and described, it will be apparent to those skilled in the art that various changes and modifications may be made without departing from the spirit and scope of the present invention.

In the first embodiment and the modifications, an analog-to-digital converter, a digital signal processor and a digital-to-analog converter may be connected in series between the adder 23*h* and the speaker system 24. In this instance, certain effects such as reverb is imparted to the electric tones through the digital processing by the digital signal processor. The analog-to-digital converter, digital signal processor and digital-to-analog converter form a signal producer together with the adder 23*h*/27*k*/30*h*. The first concept of the present invention expressed in the first embodiment and its modifications is applicable to other sorts of electric bowed stringed musical instruments corresponding to the violas, cellos and contrabasses.

In the second embodiment and its modifications, the signal electrodes of the piezoelectric transducers in the same group may be directly connected to one another. This means that the insulating layer 42*c* is removed from between the piezoelectric transducers 42*a*/42*b* and the piezoelectric transducers 42*d*/42*e*. The signal electrodes may be adhered to one another by means of a piece of conductive adhesive compound. The second concept of the present invention expressed in the second embodiment and its modifications is applicable to other sorts of electric bowed stringed musical instruments corresponding to the violas, cellos and contrabasses.

In the second embodiment, two piezoelectric transducers 42*a*/42*d* or 42*b*/42*e* form the first or second group 44*a*/44*b*. However, more than two piezoelectric transducers may form each group. Of course, more than two piezoelectric transducers are connected in parallel between the ground 45 and the signal processing system 46. It is also preferable to stack the piezoelectric transducers of each group. Insulating layers may be inserted in the stack.

In the third embodiment and its modifications, analog-to-digital converters, digital signal processors and digital-to-analog converters may be connected in series between the volume controllers 63*c*/63*f* and the speaker system 64. In this instance, certain effects such as reverb is imparted to the electric tones through the digital signal processing by the digital signal processor. The third concept of the present invention expressed in the third embodiment and its modifications is applicable to other sorts of electric bowed stringed musical instruments corresponding to the violas, cellos and contrabasses. The third concept of the present invention expressed in the third embodiment and its modifications is applicable to other sorts of electric bowed stringed musical instruments corresponding to the violas, cellos and contrabasses.

In the first and third embodiments and the modification, the vibration detectors may be another sort of vibration-to-electric signal converters such as, for example, electromagnetic sensors and optical sensors. The piezoelectric transducers never set any limit on the technical scope of the present invention.

What is claimed is:

1. An electric bowed stringed musical instrument for generating electric tones, comprising:

a vibratory body;

at least one string stretched over said vibratory body, and bowed for generating vibrations, the vibrations being propagated from said at least one string to said vibratory body;

a pickup unit connected to said vibratory body, and having a first detector for converting transverse vibration components of said vibrations to a first electric signal and a second detector for converting vertical vibration components of said vibrations to a second electric signal; and a signal processing system connected to said pickup unit, and including a first filter for transmitting low-frequency signal components of said first electric signal, a second filter for transmitting high-frequency signal components of said second electric signal and a signal producer connected to said first and second filters for producing a tone signal from said low-frequency signal components and said high-frequency signal components.

2. The electric bowed stringed musical instrument as set forth in claim 1, in which said vibratory body includes a rockable member in contact with said first and second detectors, and said vibrations of said at least one string give rise to rocking motion of said rockable member for alternately exerting force on said first and second detectors.

3. The electric bowed stringed musical instrument as set forth in claim 2, in which said rockable member has bifurcated portions held in contact with said first and second detectors and a remaining portion connected to said bifurcated portions and driven for vibrations by said at least one string.

4. The electric bowed stringed musical instrument as set forth in claim 1, in which said first detector and said second detector respectively have first piezoelectric transducers oppositely polarized and second piezoelectric transducers polarized in a same direction, and said vibratory body includes a rockable member driven for rocking motion by said at least one string so that force is alternately exerted on said first piezoelectric transducers as well as said second piezoelectric transducers.

5. The electric bowed stringed musical instrument as set forth in claim 4, in which said first piezoelectric transducers and said second piezoelectric transducers are stacked with one another between said rockable member and another member of said vibratory body.

6. The electric bowed stringed musical instrument as set forth in claim 5, in which said rockable member has bifurcated portions held in contact with the stack of said first piezoelectric transducers and said second piezoelectric transducers and a remaining portion connected to said bifurcated portions and driven for vibrations by said at least one string.

7. The electric bowed stringed musical instrument as set forth in claim 4, in which said first electric signal is output from first signal electrodes formed on first surfaces of said first piezoelectric transducers equally spaced from said rockable member, and said second electric signal is output from second signal electrodes on second surfaces of said second piezoelectric transducers equally spaced from said rockable member, electrodes formed on opposite surfaces of said first piezoelectric transducers and on opposite surfaces of said second piezoelectric transducers are connected to a constant potential source.

8. The electric bowed stringed musical instrument as set forth in claim 1, in which said first detector has plural piezoelectric transducers oppositely polarized for producing flows of electric charges serving as said first electric signal, and one of said plural piezoelectric transducers serves as said second detector so as to use one of said flows of electric charges as said second electric signal.

9. The electric bowed stringed musical instrument as set forth in claim 8, in which said flows of electric charges and said one of said flows of electric charges are supplied through respective pre-amplifiers to respective filter circuits each serving as said first filter and said second filter, and said filter circuits and said second filter supply said low-frequency signal components and said high-frequency signal components to an adder for producing said tone signal.

10. The electric bowed stringed musical instrument as set forth in claim 1, in which said vibratory body has a vibratory member and a rockable member driven for rocking motion by said at least one string, and said first detector and said second detector are provided between said at least one string and said rockable member and between said rockable member and said vibratory member, respectively.

11. The electric bowed stringed musical instrument as set forth in claim 1, in which said vibratory body includes a body, at least one peg rotatably connected to one end portion of said body and a tailpiece connected to the other end portion of said body so that said at least one string is stretched between said at least one peg and said tailpiece, said first detector and said second detector are a first microphone attached to said body for converting low-frequency vibration components of said vibrations to said first electric signal and a second microphone attached to said tailpiece for converting high-frequency vibration components of said vibrations to said second electric signal.

12. An electric bowed stringed musical instrument for generating electric tones, comprising:

a vibratory body;

at least one string stretched over said vibratory body, and bowed for generating vibrations, the vibrations being propagated from said at least one string to said vibratory body;

a pickup unit connected to said vibratory body, and including plural vibration-to-electric signal converters having respective parasitic capacitances and connected in parallel to a constant potential source for converting said vibrations to an electric signal; and a signal processing system connected to said plural vibration-to-electric signal converters, and producing a tone signal from said electric signal.

13. The electric bowed stringed musical instrument as set forth in claim 12, in which said vibratory body includes a rockable member in contact with said plural vibration-to-electric signal converters, and said vibrations of said at least one string give rise to rocking motion of said rockable member for alternately exerting force on two groups of said plural vibration-to-electric signal converters.

14. The electric bowed stringed musical instrument as set forth in claim 13, in which said rockable member has bifurcated portions held in contact with said two groups of said plural vibration-to-electric signal converters and a remaining portion connected to said bifurcated portions and driven for vibrations by said at least one string.

15. The electric bowed stringed musical instrument as set forth in claim 14, in which the vibration-to-electric signal converters of one of said two groups are stacked and held in contact with one of said bifurcated portions, and the vibration-to-electric signal converters of the other of said two groups are stacked and held in contact with the other of said bifurcated portions.

16. The electric bowed stringed musical instrument as set forth in claim 15, in which said one of said two groups includes a first piezoelectric transducer held in contact with said rockable member, serving as one of said vibration-to-electric signal converter and having a first signal electrode on a first surface reverse to the surface held in contact with said rockable member and a second piezoelectric transducer polarized oppositely to said first piezoelectric transducer, serving as another of said vibration-to-electric signal converters and having a second signal electrode on a second surface opposed to said first surface for outputting a first flow of electric charges of said electric signal from said first and second signal electrodes, and said other of said two groups includes a third piezoelectric transducer held in contact with said rockable member, polarized oppositely to said first piezoelectric transducer, serving as one of said vibration-to-electric signal converter and having a third signal electrode on a third surface reverse to the surface held in contact with said rockable member and a fourth piezoelectric transducer polarized oppositely to said third piezoelectric transducer, serving as another of said vibration-to-electric signal converters and having a fourth signal electrode on a fourth surface opposed to said third surface for outputting a second flow of electric charges of said electric signal from said third and fourth signal electrodes.

17. The electric bowed stringed musical instrument as set forth in claim 12, in which said vibratory body has a hollow space serving as a resonator.

18. An electric bowed stringed musical instrument for generating electric tones, comprising:

a vibratory body;

plural strings stretched over said vibratory body, and selectively bowed for generating vibrations, the vibrations being propagated from said plural strings to said vibratory body;

a pickup unit connected to said vibratory body, and including plural vibration-to-electric signal converters each different in distance to said plural strings, said vibratory body decaying said vibrations propagated from the bowed string or strings to said plural vibration-to-electric signal converters depending upon the distances between said bowed string or strings and said plural vibration-to-electric signal converters so that said vibration-to-electric signal converters generates electric signals differently influenced by said bowed string or strings; and a signal processing system connected to said plural vibration-to-electric signal converters, and separately producing tone signals from said electric signals.

19. The electric bowed stringed musical instrument as set forth in claim 18, in which said vibratory body includes a vibratory member having bifurcated sub-portions held in contact with said plural vibration-to-electric signal converters and a remaining sub-portion connected to said bifurcated sub-portions and held in contact with said plural strings at intervals so that each of said plural vibration-to-electric signal converters is spaced from said plural strings by said distances.

20. The electric bowed stringed musical instrument as set forth in claim 18, in which different registers are respectively assigned to said plural strings, and said signal processing system includes plural filters having respective pass bands regulating a magnitude ratio between said plural tone signals for each of said plural strings to a value spaced from values of the magnification ratio for others of said plural strings.

21. The electric bowed stringed musical instrument as set forth in claim 18, in which said plural vibration-to-electric signal converters partially serve as a first detector for converting transverse vibration components of said vibrations to said electric signals and partially serve as a second detector for converting vertical vibration components to said vibrations to another electric signal, and said signal processing system includes an adder adding said another electric signal to said electric signals for producing said tone signals.

22. The electric bowed stringed musical instrument as set forth in claim 21, in which said first detector is implemented by plural piezoelectric transducers, and one of said plural piezoelectric transducers serves as said second detector.

23. The electric bowed stringed musical instrument as set forth in claim 22, in which said plural piezoelectric transducers are oppositely polarized and are held in contact with bifurcated portions of a rockable member forming a part of said vibratory body.

* * * * *